US005931225A

United States Patent [19]

Nishishita et al.

[11] Patent Number: 5,931,225

[45] Date of Patent: Aug. 3, 1999

[54] LAMINATED HEAT EXCHANGER

[75] Inventors: Kunihiko Nishishita; Muneo Sakurada; Seiji Inoue, all of Konan, Japan

[73] Assignee: Zexel Corporation, Tokyo, Japan

[21] Appl. No.: 09/207,638

[22] Filed: Dec. 9, 1998

Related U.S. Application Data

[62] Division of application No. 08/862,173, May 22, 1997, Pat. No. 5,881,804.

[30] Foreign Application Priority Data

May 23, 1996 [JP] Japan ..... 8-151673

[51] Int. Cl.[6] ..... F28D 1/03

[52] U.S. Cl. ..... 165/153; 165/176

[58] Field of Search ..... 165/153, 174, 165/176; 62/515

[56] References Cited

U.S. PATENT DOCUMENTS

| | | | |
|---|---|---|---|
| 5,062,477 | 11/1991 | Kadle | 165/174 |
| 5,511,611 | 4/1996 | Nishishita | 165/153 |
| 5,553,664 | 9/1996 | Nishishita et al. | 165/153 |

FOREIGN PATENT DOCUMENTS

| | | | |
|---|---|---|---|
| 137493 | 6/1991 | Japan | 165/153 |

*Primary Examiner*—Leonard Leo
*Attorney, Agent, or Firm*—Wenderoth, Lind & Ponack, L.L.P.

[57] ABSTRACT

In a laminated heat exchanger, an intake portion and an outlet portion for heat exchanging medium are provided at one end portion in the direction of lamination. The intake portion is made to communicate with a most upstream pass distance from the one end portion in the direction of lamination via a communicating pipe, and the outlet portion is made to communicate with the most downstream pass at one end portion in the direction of lamination. The communicating pipe is further made to communicate with an odd-numbered pass in the vicinity where the odd-numbered pass changes from the even-numbered pass that immediately precedes it. In addition, the intake portion at one end portion in the direction of lamination is made to communicate with the pass immediately preceding the most downstream pass. Since the heat exchanging medium flows in sufficiently quantity through the tube elements in the vicinity of the downstream side of the partitioning portion, inconsistency in the temperature distribution can be avoided thereby achieving an improvement in heat exchanging efficiency.

6 Claims, 16 Drawing Sheets

LAMINATED HEAT EXCHANGER

This is a divisional application of Ser. No. 08/862,173, filed May 22, 1997 now U.S. Pat. No. 5,881,804.

BACKGROUND OF THE INVENTION

1. Field of the Invention

The present invention relates to a laminated heat exchanger employed in a cooling cycle or the like in an air conditioning system for vehicles, which is constituted by laminating tube elements and fins alternately over a plurality of levels and, in particular, relates to a laminated heat exchanger with a structure in which a pair of tank portions are formed on one side of each tube element and an intake portion and an outlet portion for heat exchanging medium are provided at one end in the direction of lamination.

2. Description of the Related Art

In order to respond to the need for further miniaturization of heat exchangers and for improvement in heat exchanging efficiency, the applicant of the present invention developed a heat exchanger whose external shape is as shown in FIG. 1A and has been conducting various research into this heat exchanger. In this heat exchanger, with its core main body formed by laminating tube elements alternately with fins over a plurality of levels, a pair of tank portions provided at one side of each tube element are made to communicate with each other through a U-turn passage portion, and a heat exchanging medium flow path with a plurality of continuous passes is formed in the core main body, as shown in FIG. 15, by making the tank portions of adjacent tube elements communicate as appropriate. An intake portion 4 and an outlet portion 5 for heat exchanging medium are provided at one end in the direction of lamination. In heat exchangers of the existing type, the intake portion 4 is made to communicate with the most upstream pass via a communicating pipe 20, and the outlet portion 5 is made to communicate directly with the pass at the most downstream pass.

In the heat exchanger described above, after the heat exchanging medium flows in through the intake portion 4, the heat exchanging medium enters the most upstream pass via the communicating pipe 20 and after going through a plurality of passes it reaches the most downstream pass before it flows out through the outlet portion 5 which is in communication with the most downstream pass. In the heat exchanger, the unidirectional flow in which the heat exchanging medium moves from the tank side toward the non-tank side or from the non-tank side toward the tank side is considered to be one pass, so that a heat exchanger in which the heat exchanging medium passes through the U-turn passage portions twice during the course of its travel from the intake portion to the outlet portion is referred to as a 4-pass heat exchanger, whereas a heat exchanger in which the heat exchanging medium passes through the U-turn passage portions three times is referred to as a 6-pass heat exchanger.

However, in a laminated heat exchanger with 4 passes as described above, since it is structured so that coolant flows out through one end of the core main body, the coolant tends to concentrate at the tube elements that are located closer to the outlet side (toward one end in the direction of lamination) when it travels from the second pass to the third pass, as shown in FIG. 16A. In other words, from the third pass through the fourth pass, the coolant does not flow readily in the area that is close to a partitioning portion $\alpha$, which partitions the first pass from the fourth pass. This point is substantiated by measured data that are represented with the broken lines in FIGS. 5A and 5B and FIGS. 10A and 10B, which indicate that the temperature of the passing air in this area is higher than that in other areas. It is to be noted that in FIGS. 5A and 5B and FIGS. 10A and 10B, tube numbers (TUBE No.) refer to the tube element number that is obtained by counting from the end where the intake portion and the outlet portion are provided to a specific tube element. In addition, the passing air temperature (AIR TEMP.) refers to the temperature of air with which heat exchange has been performed at the fins when the air passed between the tube elements, measured at a position 1~2 cm from the downstream side end surface of the core main body.

Moreover, in a 6-pass heat exchanger, too, as shown in FIG. 16B, the heat exchanging medium tends to flow while concentrating toward the outlet side away from the partitioning portion $\alpha$ and, as a result, it can be easily deduced that the temperature of the tube elements at the partitioning portion a in the vicinity of the outlet side and the passing air temperature will be different from those in other areas.

SUMMARY OF THE INVENTION

Accordingly, it is an object of the present invention to provide a laminated heat exchanger that achieves an improvement in heat exchanging efficiency by causing the heat exchanging medium to flow almost consistently without becoming concentrated in any particular area so that it flows evenly through all the tube elements.

The applicant of the present invention has observed that, in order to achieve near consistency in temperature distribution at the core main body by causing the heat exchanging medium to flow sufficiently through the tube elements that are located in the vicinity of the partitioning portion as well, the heat exchanging medium may be forcefully supplied to an odd-numbered pass apart from the main flow of the heat exchanging medium to improve the flow, and has conducted vigorous research into structures for heat exchangers based upon this finding which has culminated in the present invention.

Namely, in the laminated heat exchanger according to the present invention, which is constituted by laminating tube elements, that are each provided with a pair of tank portions at one side and a U-turn passage portion communicating between tank portions in each pair, alternately with fins over a plurality of levels, a heat exchanging medium flow path with an even number of passes that are continuous to one another is formed with each pass constituted of a flow in which the heat exchanging medium flows in one direction by making the tank portions of adjacent tube elements communicate with each other as appropriate. An intake portion and an outlet portion for the heat exchanging medium are provided at one end in the direction of lamination, the intake portion is made to communicate with the most upstream pass of the heat exchanging medium flow path via a communicating passage, the outlet portion is made to communicate with the most downstream pass of the heat exchanging medium flow path at one end in the direction of lamination and the communicating passage is made to communicate with an odd-numbered pass. The communicating area where the odd-numbered pass communicates with the communicating passage is provided in the vicinity where the odd-numbered pass changes from the even-numbered pass that immediately precedes it.

While, in this explanation, a laminated heat exchanger provided with a heat exchanging medium flow path constituted of an even number of passes may be a 4-pass or a 6-pass heat exchanger, it goes without saying that in some cases, the present invention may be adopted in a 2-pass heat exchanger or a heat exchanger with 8 passes or more. In addition, an odd-numbered pass that communicates with the communicating passage refers to the third pass in the case of a heat exchanger with four passes and refers to either the third pass or the fifth pass or both of these in the case of a heat exchanger with six passes, for instance.

Consequently, in the structure described above, the heat exchanging medium that has flowed in through the intake portion, flows into the pass at the first level in the heat exchanging medium flow path via the communicating passage and, after having traveled through a plurality of passes, reaches the last pass in the heat exchanging medium flow path and is then finally allowed to flow out through the outlet portion from the last pass. Concurrently with this flow, the heat exchanging medium inside the communicating pipe enters the odd-numbered pass directly and subsequently reaches the last pass after flowing through the downstream passes before it is allowed to flow out through the outlet portion from the last pass.

The flow of the heat exchanging medium that travels from an even-numbered pass to an odd-numbered pass tends to concentrate in an area that is distanced from the partitioning portion as explained earlier, due to the force with which it is supplied from the even-numbered pass combined with the fact that the outlet portion and the most downstream pass are in communication with each other at one end in the direction of lamination. However, since the communicating passage communicates with the odd-numbered pass and moreover, since this communicating area is provided in the vicinity where the odd-numbered pass changes from the even-numbered pass that immediately precedes it, the heat exchanging medium flows in a sufficient quantity through tube elements where the flow rate of the coolant would otherwise tend to be low (the tube elements located in the vicinity where the odd-numbered pass changes from the pass that immediately precedes it among the tube elements constituting the odd-numbered pass) as well as the remaining tube elements. Thus, as indicated with the solid lines in FIGS. 5A and 5B, any significant inconsistency in temperature distribution is eliminated, achieving the object mentioned above.

Alternatively, in order to achieve consistency in temperature distribution at the core main body, the heat exchanger may be constituted by tube elements, that are each provided with a pair of tank portions at one side and a U-turn passage portion communicating between the tank portions in each pair, laminated alternately with fins over a plurality of levels. Tank portions of adjacent tube elements communicate as appropriate to form a heat exchanging medium flow path with an even number of continuous passes with each of the passes constituted of a flow in which the heat exchanging medium flows in one direction. An intake portion and an outlet portion are provided for the heat exchanging medium at one end in the direction of lamination. The intake portion communicates with the most upstream pass of the heat exchanging medium flow path via a communicating pipe, the outlet portion communicates with the most downstream pass of the heat exchanging medium flow path at one end in the direction of lamination and the intake portion communicates with the pass that immediately precedes the most downstream pass at one end in the direction of lamination.

In this structure, the heat exchanging medium that has flowed in through the intake portion, flows into the most upstream pass of the heat exchanging medium flow path via the communicating pipe and, after completing a plurality of passes, reaches the most downstream pass of the heat exchanging medium flow path, finally flowing out through the outlet portion from the most downstream pass. Concurrently with this, the heat exchanging medium at the intake portion flows into the pass that immediately precedes the most downstream pass from the one end in the direction of lamination and, after this, it flows through the passes on the downstream side to reach the most downstream pass before it is allowed to flow out through the outlet portion from the most downstream pass.

Because of this, at the pass that immediately precedes the most downstream pass, the heat exchanging medium delivered from the immediately preceding even-numbered pass and the heat exchanging medium that flows in directly from the intake portion conflux to be distributed almost consistently through the tube elements constituting this pass, and thus, as indicated with the solid lines in FIGS. 10A and 10B, any significant inconsistency in the temperature distribution in a 4-pass heat exchanger is eliminated.

If, on the other hand, there are a greater number of passes, as in a heat exchanger with 6 passes or more, or if there are many tube elements constituting each pass, as in a heat exchanger with two passes, consistency in the distribution of heat exchanging medium is still a cause for concern, even with the intake portion being made to communicate with the pass immediately preceding the most downstream pass. However, in such a case, the problem can be precluded by combining the structure described above, in which the communicating passage is made to communicate with an odd-numbered pass with the communicating portion of the odd-numbered pass and the communicating passage located in the vicinity where an odd-numbered pass changes from an even-numbered pass that immediately precedes it.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings:

FIG. 6A is a bottom view of a 6-pass laminated heat exchanger showing the structure adopted when heat exchanging medium is allowed to flow into the first and the third passes, whereas

FIG. 7A is a bottom view of a 6-pass laminated heat exchanger showing the structure adopted when heat exchanging medium is allowed to flow into the first, third and fifth passes, whereas

DETAILED DESCRIPTION OF THE PREFERRED EMBODIMENTS

Figure 1A:
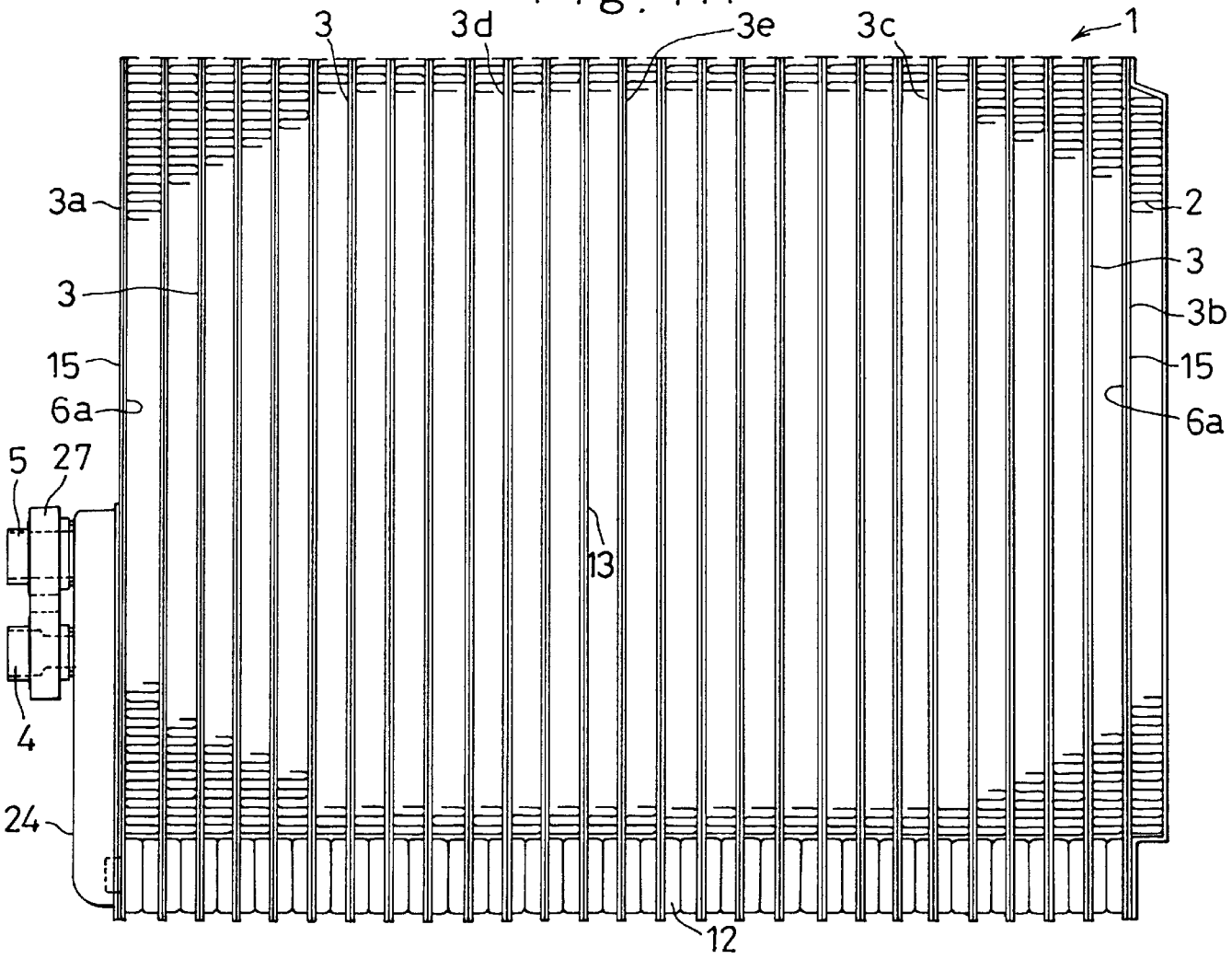
FIG. 1 shows a laminated heat exchanger according to the present invention, with FIG. 1A showing an end surface which forms a right angle relative to a direction of airflow, and FIG. 1B showing a side surface where an intake portion and an outlet portion are provided.
Figure 1B:
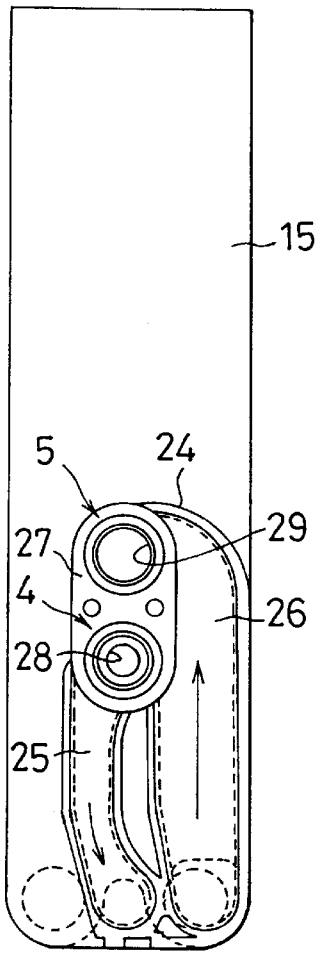
Figure 2A:
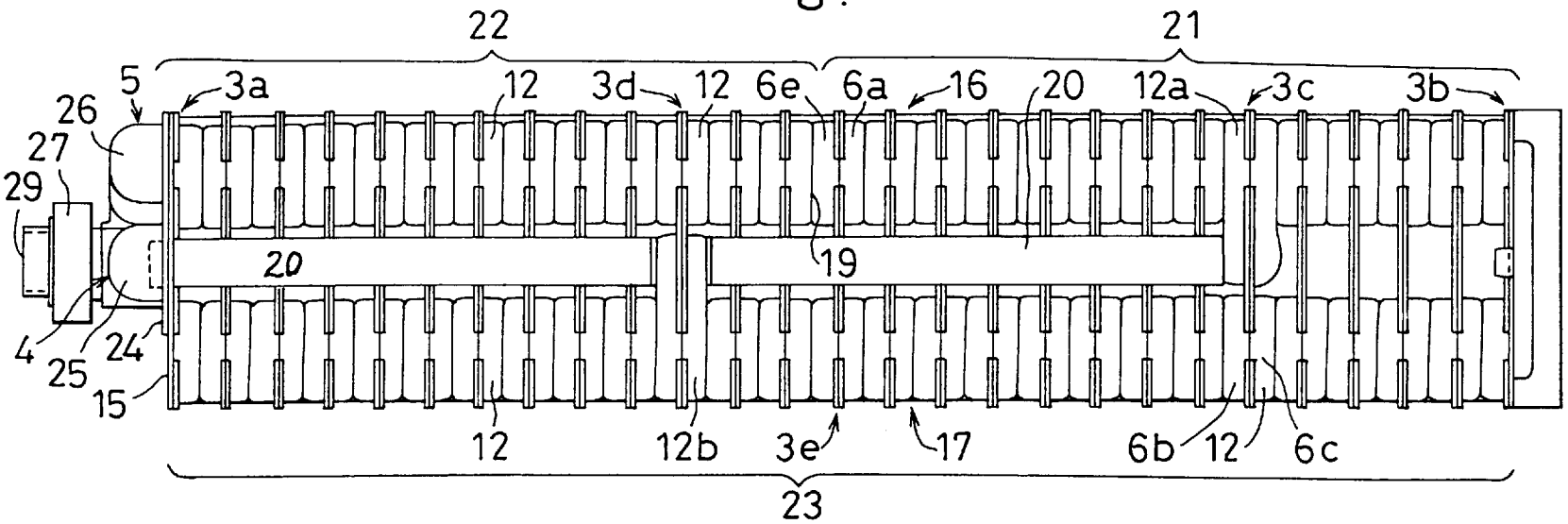
FIG. 2A is a bottom view of the 4-pass laminated heat exchanger shown in FIG. 1
Figure 2B:
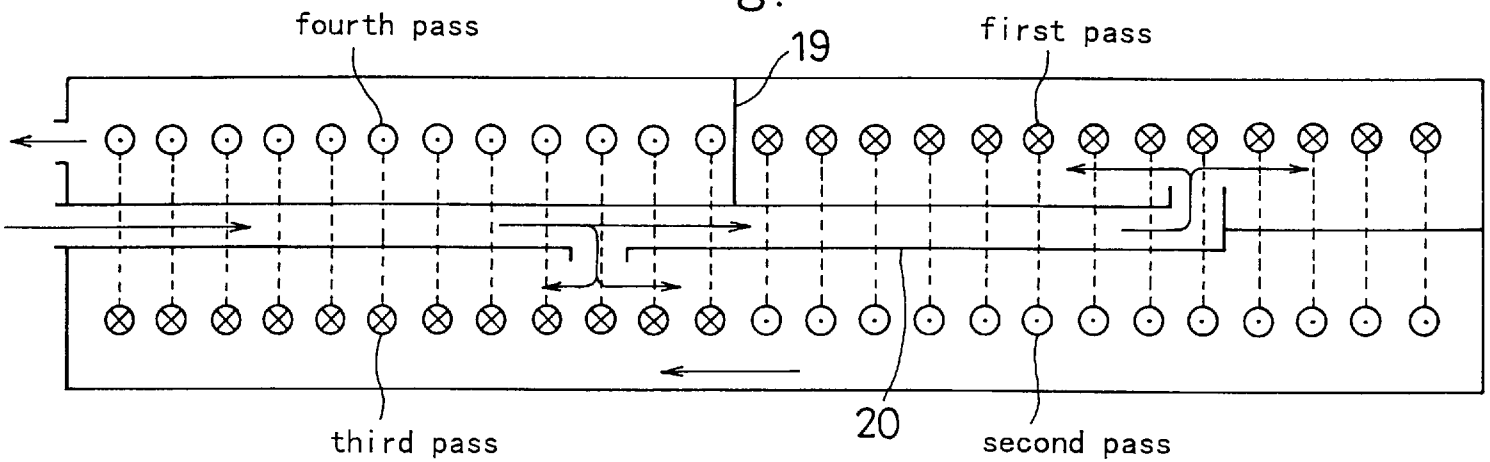
FIG. 2B is a conceptual diagram that illustrates a flow of heat exchanging medium in the laminated heat exchanger shown in FIG. 1.
Figure 3:
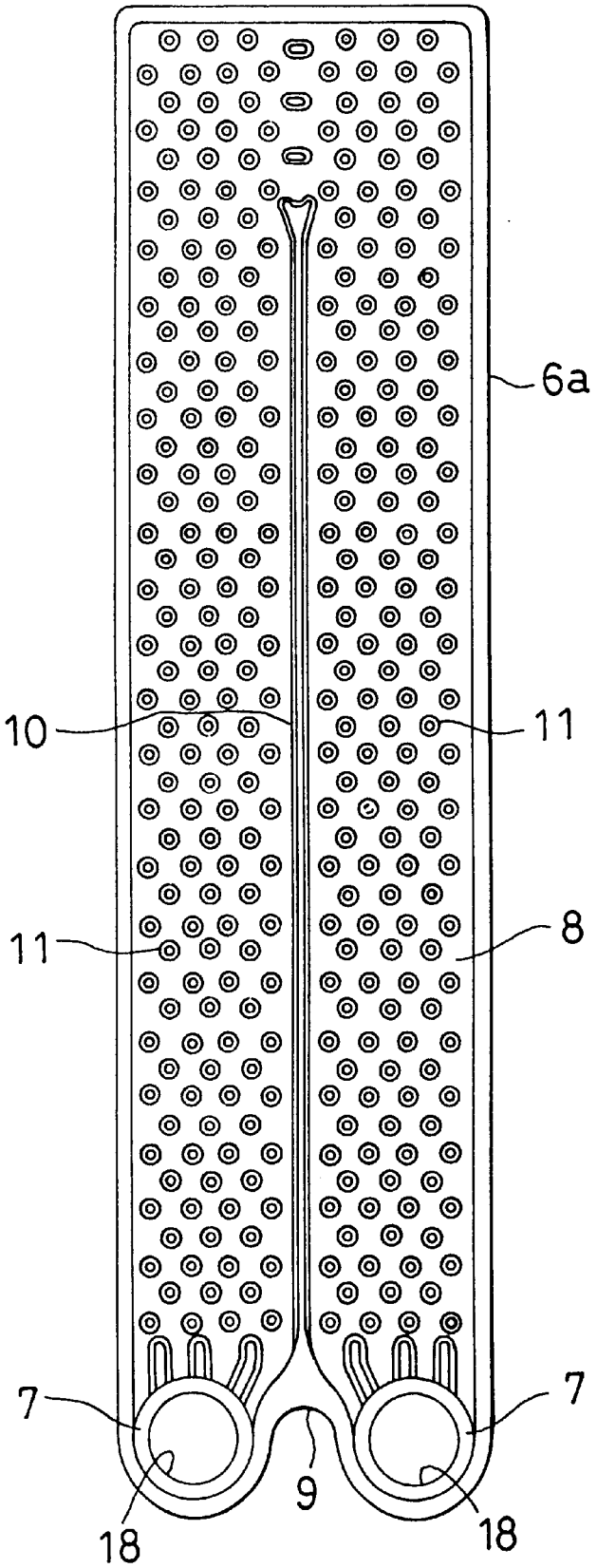
FIG. 3 shows a standard formed plate that is employed in the greatest number to constitute the heat exchanger shown in FIG. 1.

The following is an explanation of preferred embodiments according to the present invention. In FIGS. 1 and 2, a laminated heat exchanger 1 is, for instance, a 4-pass type evaporator in which a core main body is constituted by laminating fins 2 and tube elements 3 alternately over a plurality of levels and an intake portion 4 and an outlet portion 5 for heat exchanging medium are provided at one end in the direction of lamination of the tube elements 3. Except for tube elements 3*a* and 3*b* at the two ends in the direction of lamination, tube elements 3*c* and 3*d* provided with enlarged tank portions and a tube element 3*e* located approximately at the center, which are to be detailed later, each of the tube elements 3 is constituted by bonding two formed plates 6*a*, one of which is shown in FIG. 3.

The formed plate 6*a* is formed by press machining an aluminum plate, and is provided with two roughly hemispherical distended tank portions 7 and 7 at one end with a distended passage portion 8 formed continuously with the distended tank portions. An indented portion 9 for mounting a communicating pipe, to be detailed later, is formed between the distended tank portions. In addition, at the distended passage portion 8, a projection 10 is formed to extend from the area between the distended tank portions 7 and 7 to the vicinity of the free end of the formed plate 6a. It is to be noted that reference number 11 indicates circular beads that are formed in the formed plate in order to improve the heat exchanging efficiency and when two formed plates are bonded to each other, each bead 11 becomes bonded with the bead formed at the position opposite thereto.

The distended tank portions 7 are formed to distend to a greater degree than the distended passage portion 8, and the projection 10 is formed so that it is on the same plane as the bonding margin at the circumferential edges of the formed plate. Thus, when two formed plates 6*a* are bonded to each other at their circumferential edges, their projections 10 also become bonded, a pair of tank portions 12 and 12 are formed from the distended tank portions 7 that face opposite each other and a U-turn passage portion 13 that connects the two tank portions is formed by the distended passage portions 8 that face opposite each other.

Figure 4A:
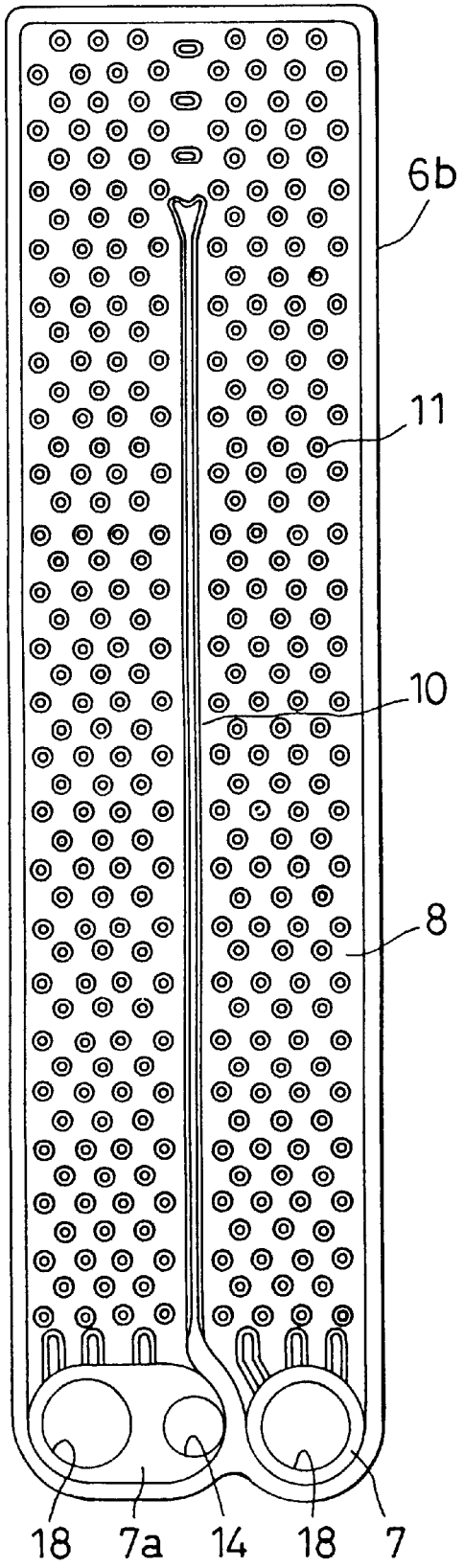
FIG. 4 shows formed plates that are employed in a tube element provided with an extended tank portion, with FIG. 4A showing a formed plate provided with an extended distended tank formation portion having a through hole for inserting a communicating pipe therein, and FIG. 4B showing a formed plate provided with an extended distended tank formation portion without the through hole for inserting the communicating pipe.
Figure 4B:
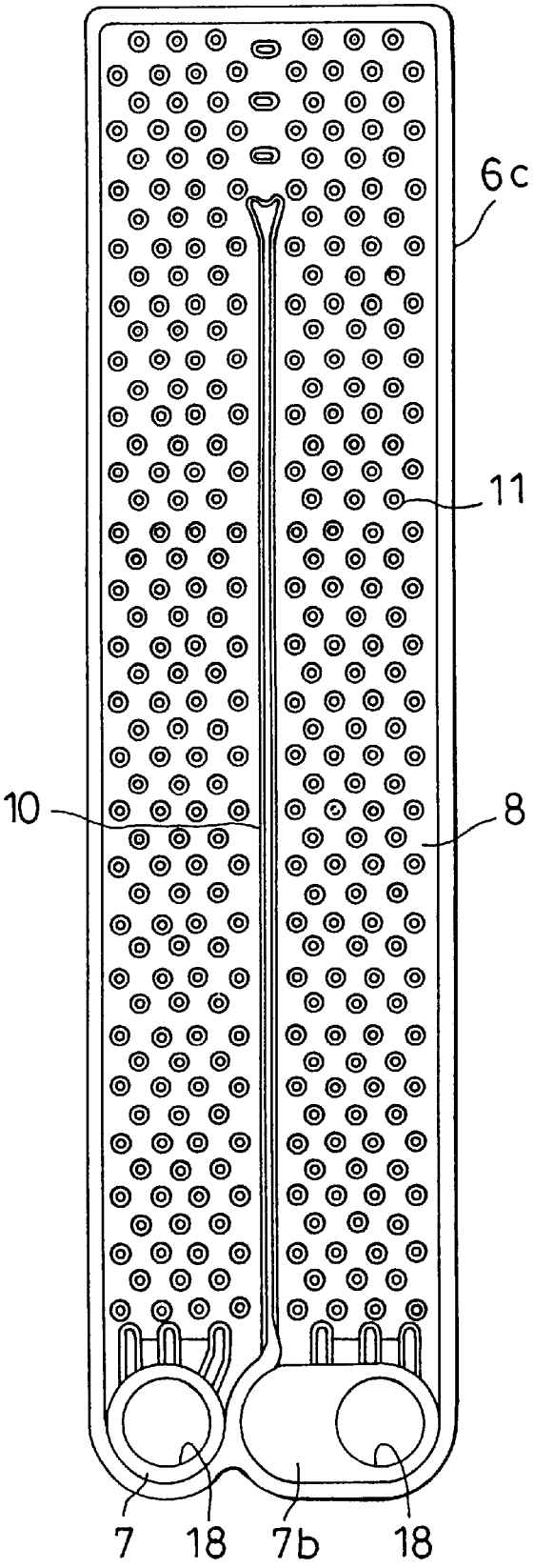

The tube elements 3*a* and 3*b* located at the two ends in the direction of lamination are each constituted by bonding a flat plate 15 to the outside of the formed plate 6*a* shown in FIG. 2. In addition, the tube elements 3*c* and 3*d* are each provided with one tank portion 12 which is the same size as those in the tube elements 3 and are respectively provided with tank portions 12*a* and 12*b* that are enlarged so as to fill in the indented portion. Of these, the tube element 3*c* is constituted by combining formed plates 6*b* and 6*c* shown in FIGS. 4A and 4B respectively, and in each of the formed plates 6*b* and 6*c*, one of the distended tank portions, i.e., a distended tank portion 7*a* or 7*b*, is formed enlarged so that it approaches the other distended tank portion 7. A through hole 14 through which a communicating pipe 20, to be detailed later, is to be inserted and bonded, is formed at the distended tank portion 7*a*, which is formed enlarged in the formed plate 6*b*. The tube element 3*d*, on the other hand, is constituted by combining the formed plate 6*b* (described earlier) shown in FIG. 4A and a formed plate that has a shape symmetrical to the formed plate 6*b*, for instance, and bonded with the communicating pipe 20, which passes through the through hole 14.

Since other structural features of the formed plates 6*b* and 6*c* are identical to those in the formed plate 6*a* shown in FIG. 3, i.e., in that the distended passage portion 8 is formed continuous to the distended tank portions, that the projection 10 is formed extending from the area between the distended tank portions 7 to the vicinity of the free end of the formed plate and the like, their explanation is omitted.

As shown in FIGS. 1 and 2, in the heat exchanger 1, adjacent tube elements are abutted with each other at their tank portions to form two tank groups, i.e., a first tank group 16 and a second tank group 17 that extend in the direction of lamination (perpendicular to the direction of airflow), and in one of the tank groups, i.e., the tank group 16, which includes the enlarged tank portion 12*a*, the individual tank portions are in communication via the through holes 18 formed at the distended tank portions 7 except for in the formed plate 6*e* that is located approximately at the center in the direction of lamination. However, in the other tank group 17, all the tank portions are in communication via the through holes 18 without any partitioning.

As for the tube element 3*e*, which is constituted by combining the formed plate 6*a* shown in FIG. 3 and a formed plate 6*e*, whose external shape is identical to that of the formed plate 6*a* but with no through hole formed at the distended tank portion on one side, this non communicating portion forms a partitioning portion 19 that partitions one of the tank groups, i.e., the tank group 16. The partitioning portion 19 may be constituted by blocking off the through hole with a thin plate inserted between the tube element 3*e* and the adjacent tube element, instead of blocking off the distended tank portion.

As a result, the first tank group 16 is partitioned into a first tank block 21 that includes the enlarged tank portion 12*a*, and a second tank block 22 that communicates with the outlet portion 5, by the partitioning portion 19, whereas the non-partitioned second tank group 17 constitutes a third tank block 23. It is to be noted that in this embodiment, the tube element 3*d* is provided at the 11th level, the tube element 3*e* is provided at the fourteenth level and the tube element 3*c* is provided at the twenty-second level counting from the left end in the figures (the end where the intake portion 4 and the outlet portion 5 are provided).

The intake portion 4 and the outlet portion 5, which are provided at one end in the direction of lamination, are constituted by bonding a an intake and outlet passage plate 24 with the flat plate 15 of the tube element 3*a*, with an intake passage 25 and an outlet passage 26 formed between these plates extending from a position approximately half way along the lengthwise direction of the flat plate 15 toward the tank portion.

At the upper portion of the intake passage 25 and the outlet passage 26, an inflow port 28 and an outflow port 29 respectively are provided via a coupling 27 which secures an expansion valve. The intake passage 25 and the enlarged tank portion 12*a* are made to communicate with each other through a communicating passage that is constituted of the communicating pipe 20 secured at the indented portions 9. The outlet passage 26 is made to communicate with the second tank block 22 via a hole formed at the plate 15.

In addition, the communicating pipe 20 mounted at the indented portions 9 is mounted by passing through the through holes 14 in the individual plates constituting the tube element 3*d* and is brazed so that no gap is formed between itself and the through holes 14 thereby forming a circumferential wall hole at the area where it is inserted in the tank portion 12*b* to allow coolant to flow out into the tank portion 12*b*.

In the structure described above, the coolant that has flowed in through the intake portion 4 enters the enlarged tank portion 12*a* through the communicating pipe 20, becomes dispersed throughout the entirety of the first tank block 21 and travels upward along the projections 10 through the U-turn passage portions 13 of the tube elements that corresponds to the first tank block 21 (first pass). Then, it makes a U-turn above the projections 10 before traveling downward (second pass) and reaches the tank group on the opposite side (third tank block 23). After this, it travels horizontally to the remaining tube elements that constitute the third tank block 23 before traveling upward again along the projections 10 through the U-turn passage portion 13 of the tube elements (third pass). Next, it travels downward after making a U-turn above the projections 10 (fourth pass) is led to the tank portions constituting the second tank block 22 and finally flows out through the outlet portion 5.

Concurrently with this main flow, the coolant that has been led into the communicating pipe 20 enters the third tank block 23 from the enlarged tank portion 12*b* of the tube element 3*d* via a side wall hole and flows through the U-turn passage portions 13 of the tube elements constituting the third pass while joining the main flow delivered from the second pass and then finally flows out through the outlet portion 5.

Figure 5A:
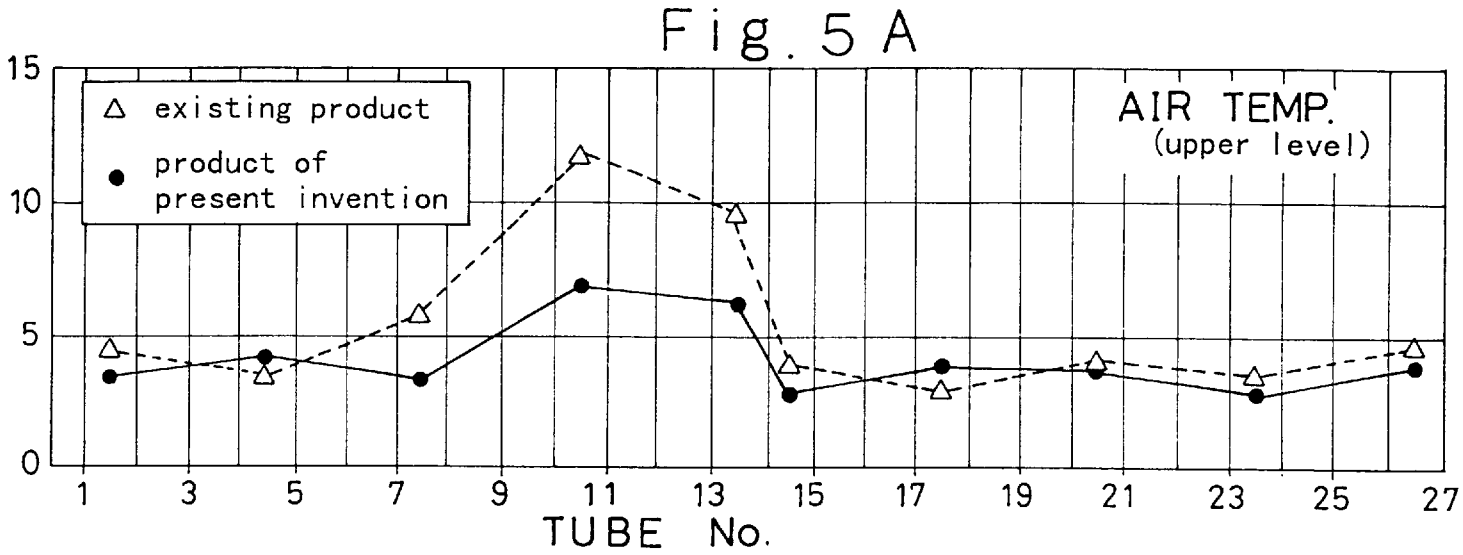
FIG. 5 shows the temperature of discharge air when the laminated heat exchanger shown in FIG. 1 is utilized, with FIG. 5A presenting a characteristic diagram representing the temperature of air that has passed through the upper level of the laminated heat exchanger (representative temperature of air having passed through the upper half between the tube elements) and FIG. 5B presenting a characteristic diagram representing the temperature of air that has passed through the lower level of the laminated heat exchanger (representative temperature of air having passed through the lower half between the tube elements)
Figure 5B:
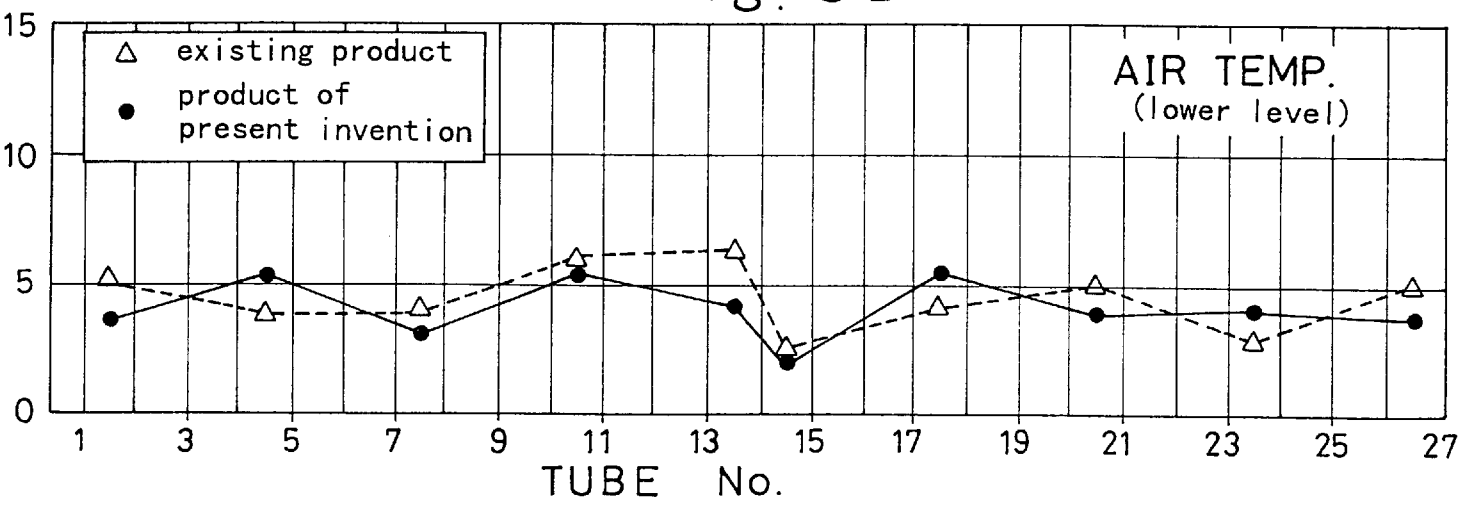

During this process, since the outlet portion 5 is connected to the second tank block 22 via an end portion of the core main body in the direction of lamination, it is a cause for concern that the coolant traveling from the second pass to the third pass may concentrate in the tube elements close to the outlet portion, as explained earlier. However, since the communicating pipe 20 is in communication with the third pass in the vicinity where it changes from the second pass, the coolant will flow in sufficient quantity through the tube elements in the vicinity of the partitioning portion 19 of the tube elements constituting the third and fourth passes. This flow is substantiated by the temperature distribution, which is made consistent overall with the temperature of the air passing through in the vicinity of partitioning portion 19 in the vicinity of the outlet (in particular, among TUBE Nos. 7~13) being reduced compared to that in a heat exchanger in the prior art, as indicated by the solid lines in FIGS. 5A and 5B.

Figure 6A:
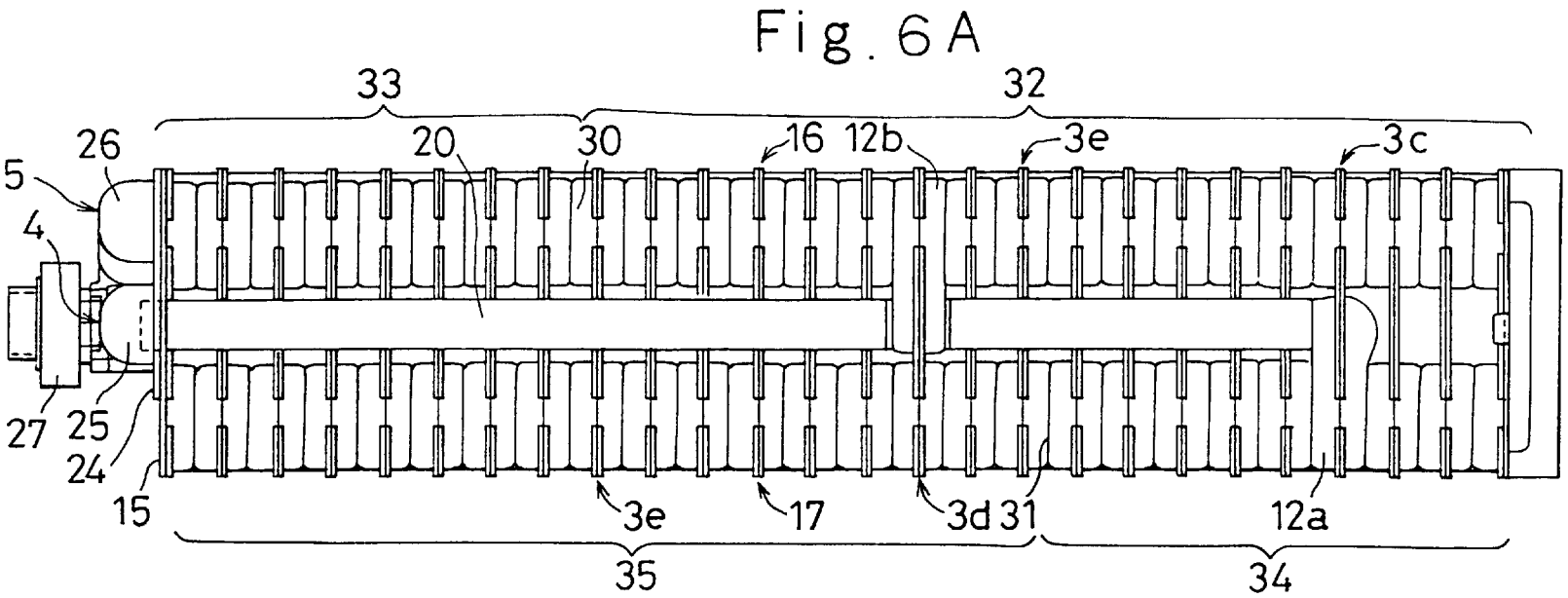
Figure 6B:
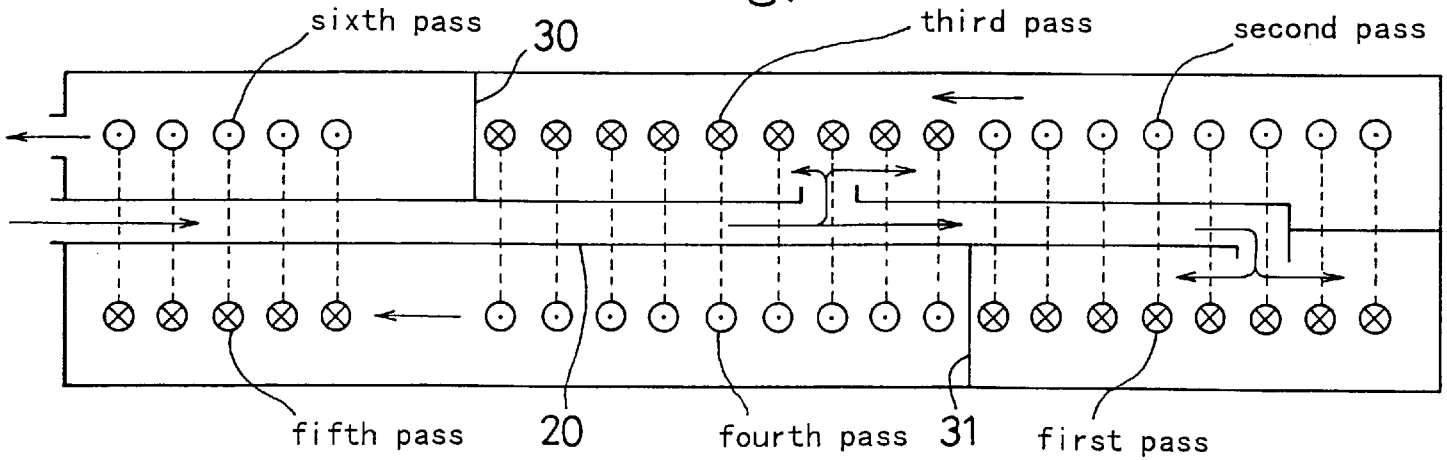
FIG. 6B is a conceptual diagram illustrating the flow of the heat exchanging medium in this 6-pass laminated heat exchanger.
Figure 7A:
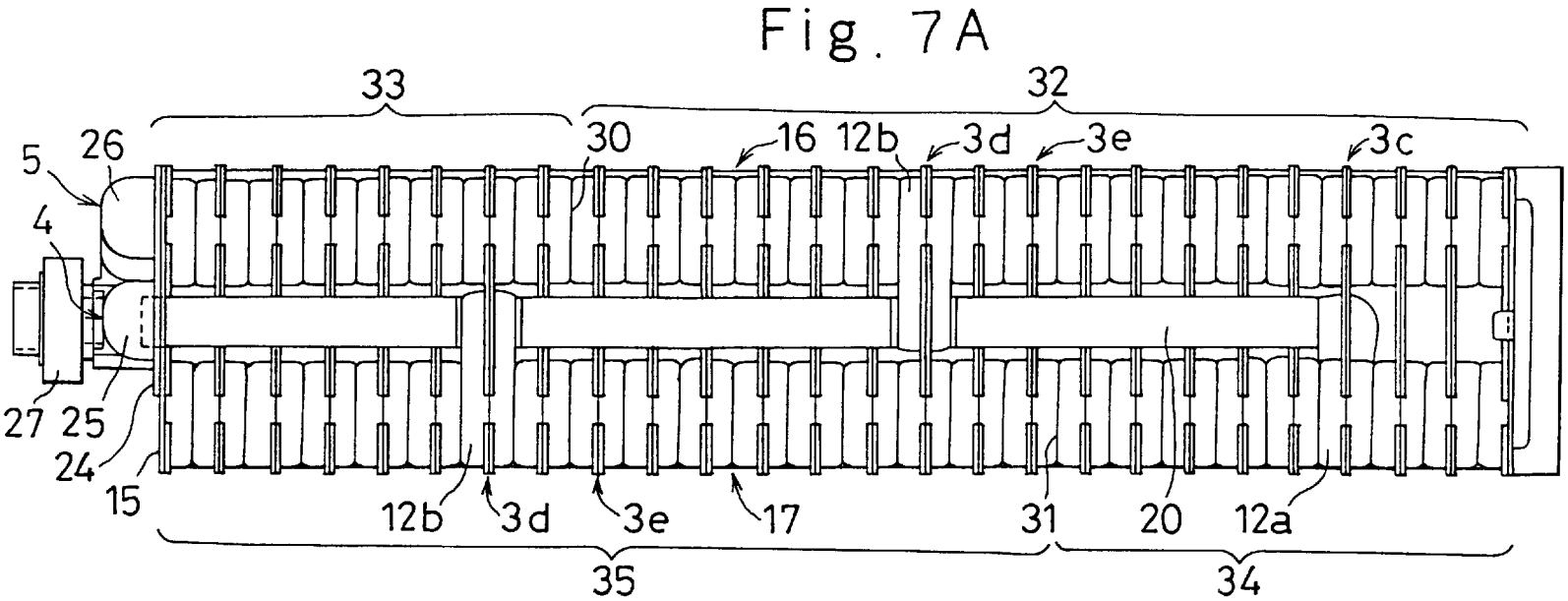

FIGS. 6 and 7 show structures that are achieved when the technical concept described above is adopted in a 6-pass heat exchanger. In FIG. 6, an example in which tube elements are laminated over 26 levels is shown, with tube elements 3*e*, which are not provided with a through hole, positioned at the ninth and seventeenth levels counting from the end where the intake portion 4 and the outlet portion 5 are provided, A partitioning portion 30 that partitions the first tank group 16, is constituted of the tube element 3*e* at the ninth level and a partitioning portion 31, which partitions the second tank group 17 is constituted of the tube element 3*e* at the seventeenth level. In addition, the tube element 3*d* and the tube element 3*c* respectively are provided at the fifteenth level and the twenty third level. In the tube element 3*c*, the tank portion 12*a* is enlarged to extend toward the first tank group 16 and, in the tube element 3*d*, the tank portion 12*b* is enlarged to extend toward the second tank group 17. Moreover, in correspondence to this structure, the position of the peripheral wall hole of the communicating pipe 20, too, is set in accordance with the position of the tube element 3*d*.

As a result, the first tank group 16 is divided by the partitioning portion 30 into two blocks, i.e., a first tank block 32 that includes the enlarged tank portion 12*b*, and a second tank block 33 that communicates with the outlet portion 5, whereas the second tank group 17 is divided by the partitioning portion 31 into two blocks, i.e. a third tank block 34 that includes the enlarged tank portion 12*a* and a fourth tank block 35 constituted of the remaining tube elements.

In such a structure, the coolant that has flowed in through the intake portion 4 becomes dispersed throughout the entirety of the third tank block 34 after traveling through the communicating pipe 20, and reaches the tank group on the opposite side (first tank block 32) by traveling through the U-turn passage portions 13 of the tube elements that correspond to the third tank block 34 (first and second passes). After that, the coolant travels horizontally to the remaining tube elements that constitute the first tank block 32, is then led to the tank portions constituting the fourth tank block 35 by traveling through the U-tum passage portions 13 of those tube elements (third and fourth passes), then further travels horizontally to the remaining tube elements constituting the fourth tank block 35 and is then led to the tank portions constituting the second tank block 33 after traveling through the U-turn passage portions 13 again (fifth and sixth passes) and finally, it flows out through the outlet portion 5. In addition, concurrently with this main flow, the coolant that has been led into the communicating pipe 20, flows into the first tank block 32 via the enlarged tank portion 12*b* of the tube element 3*d* and, as it joins the coolant in the main flow that is delivered from the second pass, flows through the third and subsequent passes before flowing out through the outlet portion 5.

Thus, since the communicating pipe 20 is connected to the third pass in the vicinity where it changes from the second pass, the coolant flows in sufficient quantity into the tube elements that are close to the partitioning portion 31 of the tube elements constituting the third and fourth passes. This achieves a more consistent temperature distribution compared to heat exchangers in the prior art, at least at the central area of the core main body.

Now, in the 6-pass heat exchanger described above, while it is obvious that the flow of coolant is improved in the third and fourth passes, it is still a cause for concern that the coolant may concentrate toward the outlet portion in the fifth and sixth passes. In order to eliminate this problem, in the heat exchanger shown in FIG. 7, a structure is achieved in which coolant is made to flow directly into the fifth pass in the vicinity where it changes from the fourth pass. In other words, the tube element 3*d*, whose enlarged tank portion 12*b* is set toward the second tank group 17, is positioned at the seventh level in the heat exchanger shown in FIG. 6 and a peripheral wall hole that opens within this tank portion 12*b* is formed at the communicating pipe 20 which passes through the tank portion 12*b* at the seventh level.

Figure 7B:
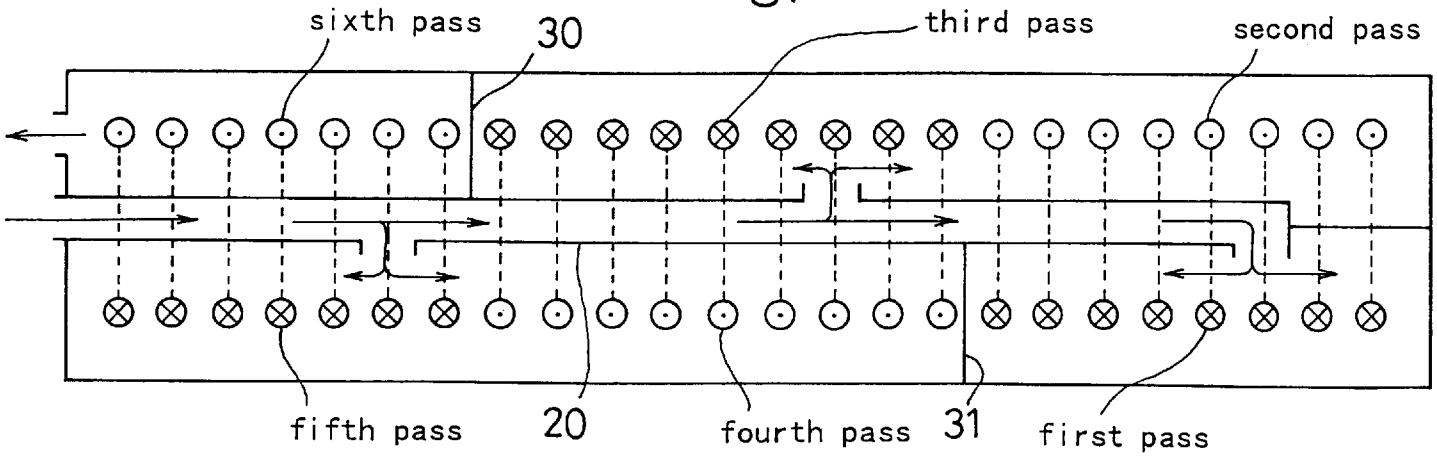
FIG. 7B is a conceptual diagram illustrating the flow of the heat exchanging medium in this 6-pass laminated heat exchanger.

In this structure, as shown in FIG. 7B, the coolant flows in sufficient quantity through the tube elements in the vicinity of the downstream side of the partitioning portion 30 as well as in the vicinity of the downstream side of the partitioning portion 31, making it possible to disperse the coolant almost consistently throughout the tube elements and achieving a further consistency in the temperature of the air passing through the heat exchanger.

Figure 8A:
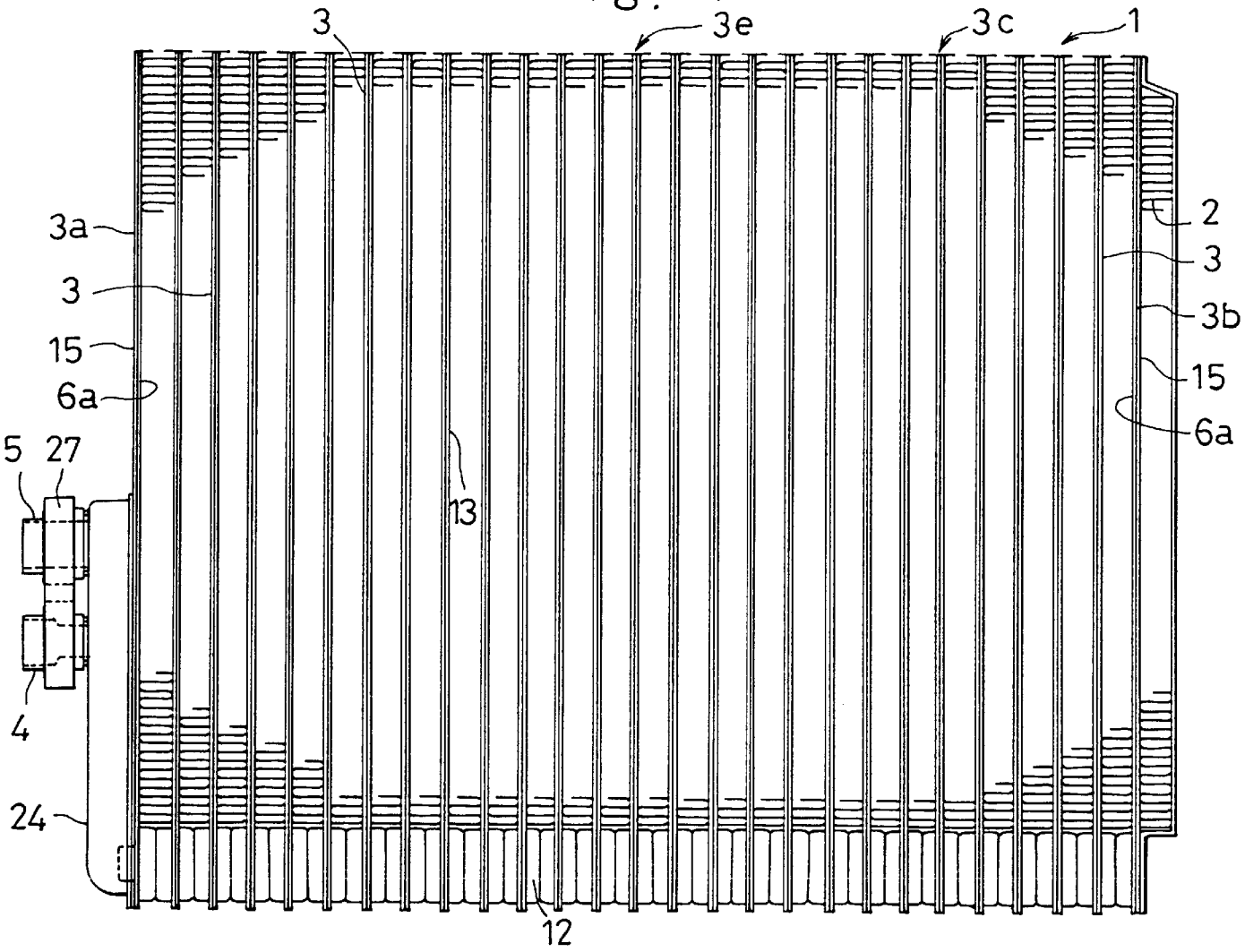
FIG. 8 shows another embodiment of the laminated heat exchanger according to the present invention, with FIG. 8A showing an end surface that forms a right angle relative to the direction of airflow and FIG. 8B showing a side surface where the intake portion and the outlet portion are provided.
Figure 8B:
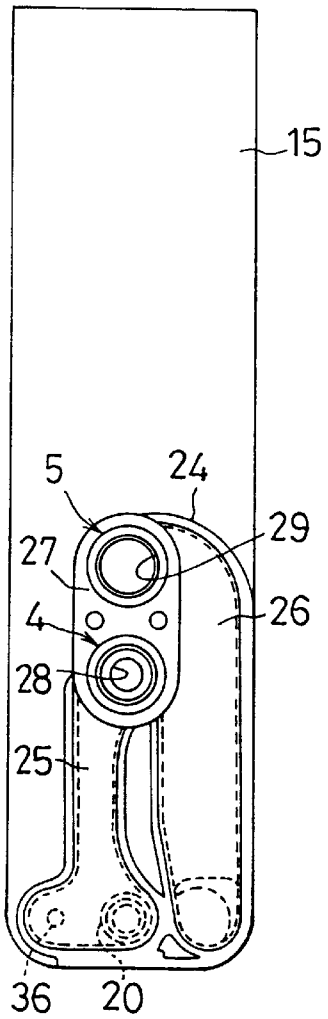
Figure 9A:
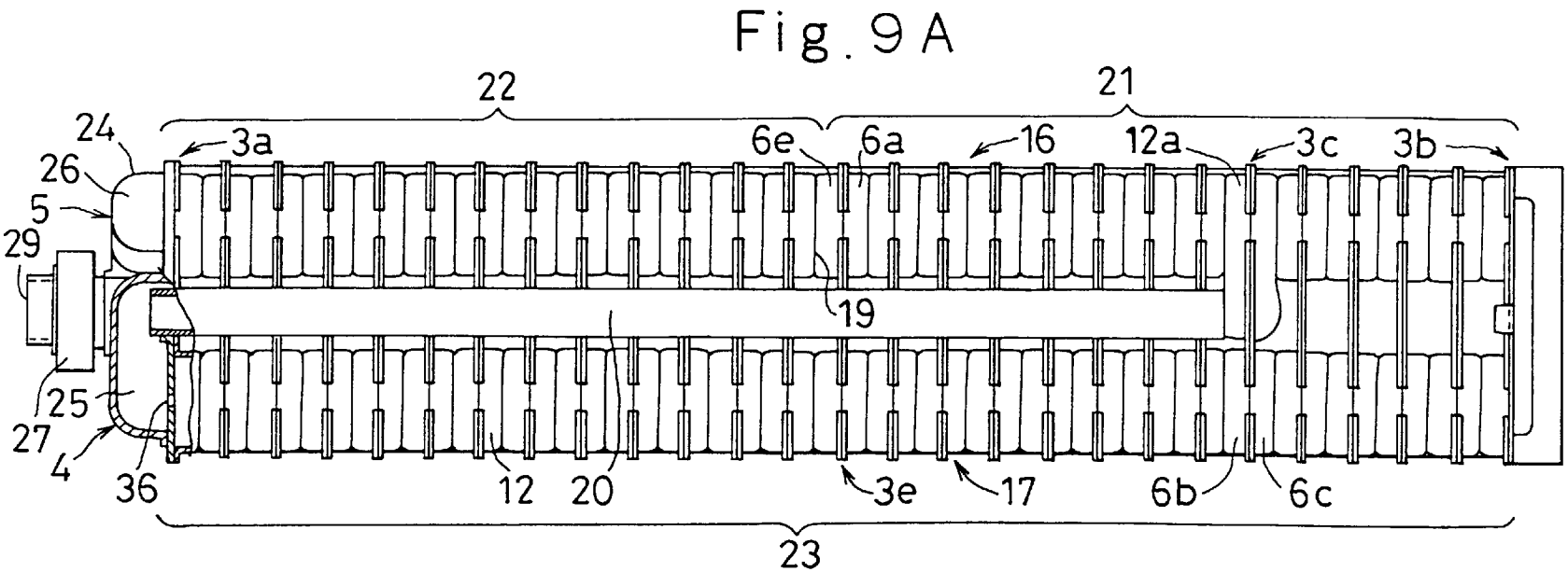
FIG. 9A is a bottom view of the 4-pass laminated heat exchanger shown in FIG. 8.
Figure 9B:
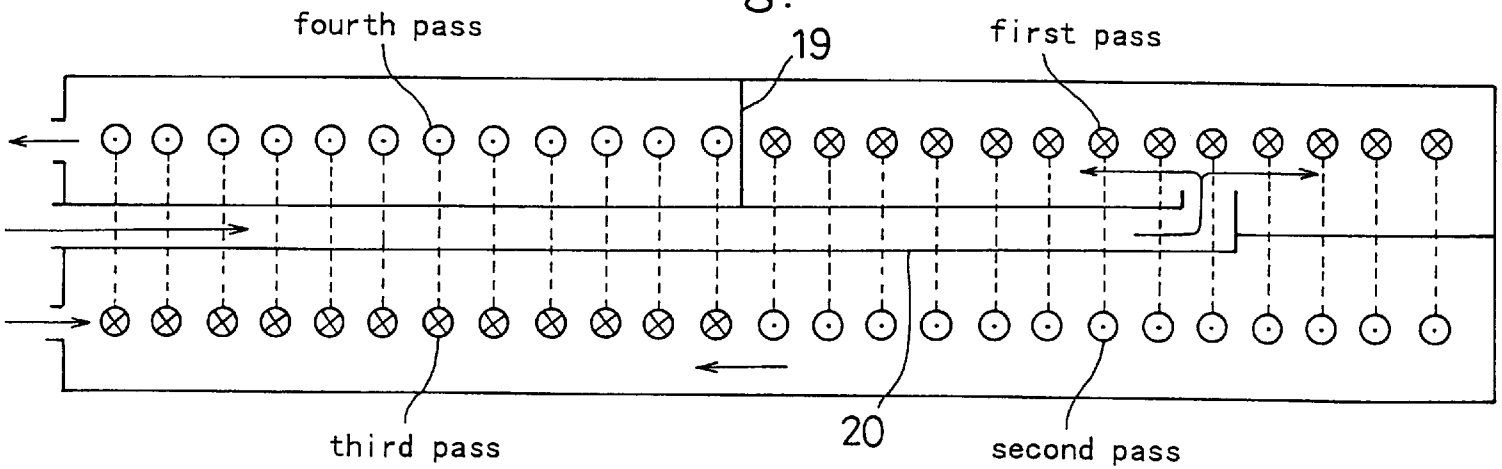
FIG. 9B is a conceptual diagram illustrating the flow of heat exchanging medium in the laminated heat exchanger in FIG. 8.

FIGS. 8 and 9 show another embodiment according to the present invention, and an explanation will be given below mainly of components that are different from the previous embodiment. The same reference numbers are assigned to components identical to those in the previous drawings, with their explanations being omitted.

In this laminated heat exchanger, which is a 4-pass exchanger, as is the case with the heat exchanger shown in FIGS. 1 and 2, the communicating pipe 20 is employed only to communicate between the intake portion 4 and the enlarged tank portion 12*a* of the tube element 3*c* and the intake passage 25 constituting the intake portion 4 is expanded in the direction away from the outlet passage 26 so that it can communicate with the third pass, i.e., the pass that immediately precedes the most downstream pass, via a small hole 36 formed in the flat plate 15. This small hole 36 is formed so that its diameter is smaller than that of the communicating pipe 20 to ensure that the coolant does not flow into the third pass from the intake portion 4 in great quantity.

In this structure, the coolant that has flowed in through the intake portion 4 enters the enlarged tank portion 12*a* after traveling through the communicating pipe 20, becomes dispersed throughout the entirety of the first tank block 21 and then travels upward along the projections 10 through the U-turn passage portions 13 of the tube elements that correspond to the first tank block 21 (first pass). After that, it makes a U-turn above the projections 10 and travels downward (second pass) reaching the tank group on the opposite side (third tank block 23). Next, it travels horizontally to the remaining tube elements that constitute the third tank block 23, and travels upward again along the projections 10 through the U-turn passage portions 13 of those tube elements (third pass). Then, it makes a U-turn above the projections 10 before traveling downward (fourth pass), is led to the tank portions constituting the second tank block 22 and finally flows out through the outlet portion 5.

While the coolant travels in this main flow, the coolant at the intake portion 4 enters the third tank block 23 via the small hole 36, joins the coolant in the main flow that is delivered from the second pass and, together, they travel upward along the projections 10 through the U-turn passage portions 13 of the tube elements constituting the third pass. Then, it makes a U-turn above the projections 10 before traveling downward (fourth pass) and finally flows out through the outlet portion 5.

Figure 10A:
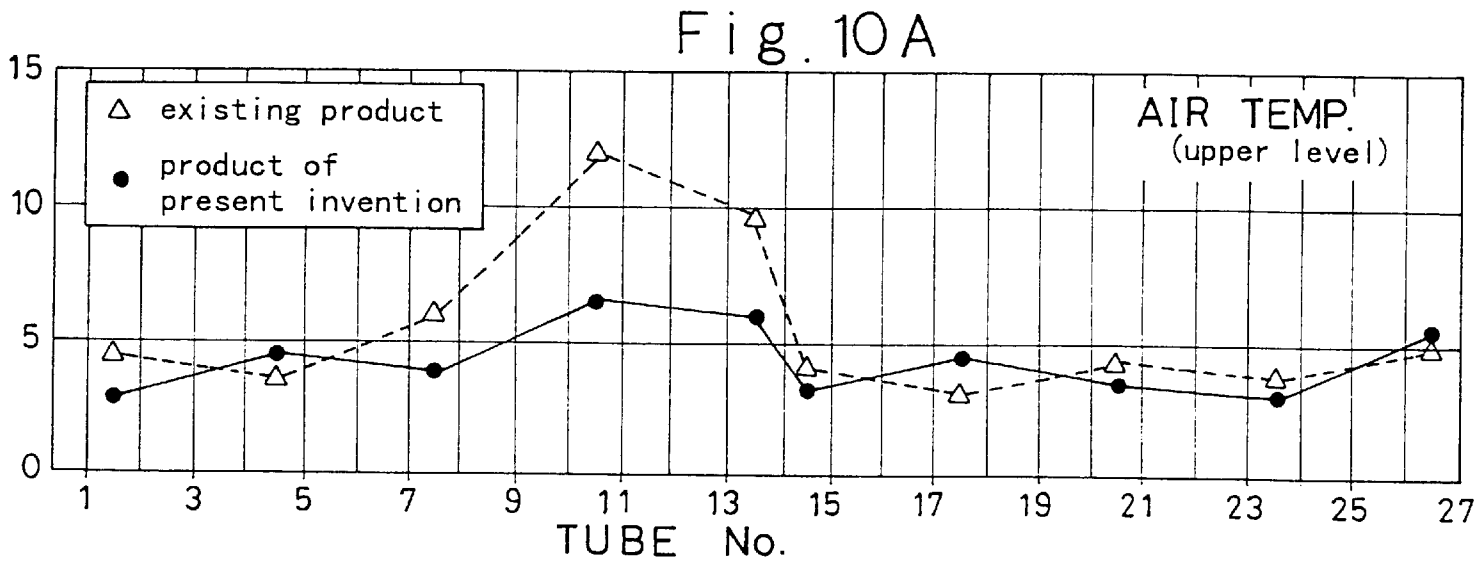
FIG. 10 shows the temperature of discharge air when the laminated heat exchanger shown in FIG. 8 is utilized, with FIG. 10A presenting a characteristic diagram representing the temperature of air that has passed through the upper level of the laminated heat exchanger (representative temperature of air having passed through the upper half between the tube elements) and FIG. 10B presenting a characteristic diagram representing the temperature of air that has passed through the lower level of the laminated heat exchanger (representative temperature of air having passed through the lower half between the tube elements)
Figure 10B:
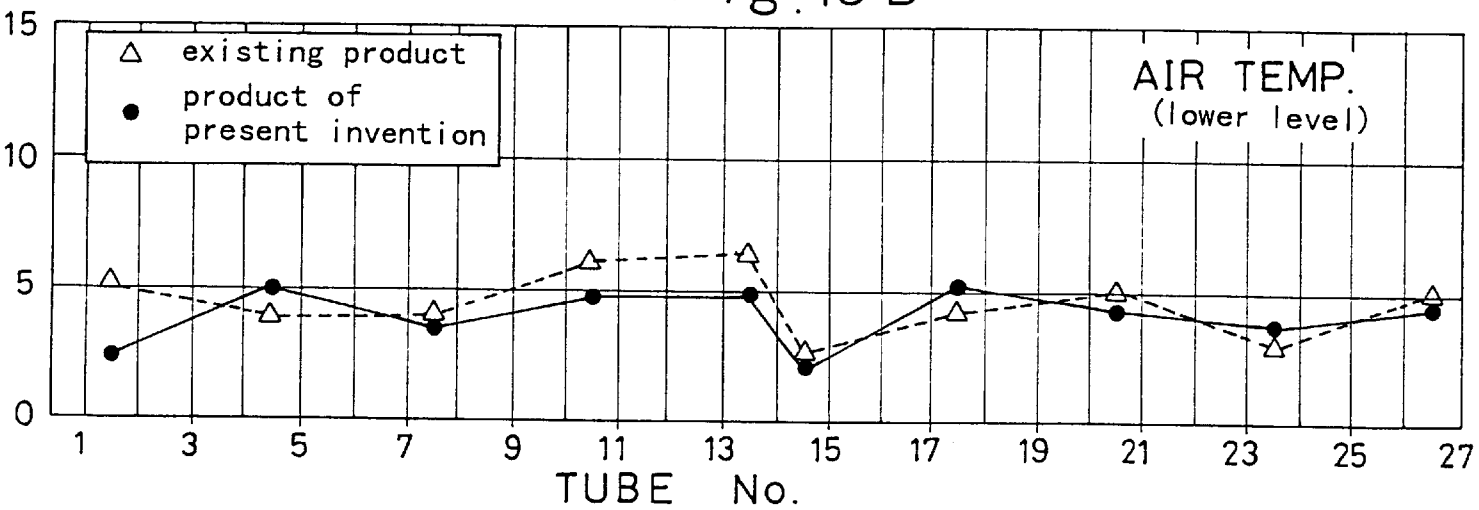

Thus, the coolant delivered from the second pass and the coolant flowing in through the intake portion 4 both gather in the tank group constituting the third pass in the third tank block and, furthermore, the coolant delivered from the second pass and the coolant flowing in through the intake portion 4 conflux in directions that are opposite each other to inhibit the force with which the coolant delivered from the second pass would otherwise flow toward the outlet, ensuring that the coolant flows in a sufficient quantity into the tube elements in the vicinity of the outlet side of the partitioning portion 19 of the tube elements constituting the third and fourth passes. As a result, as indicated with the solid lines in FIGS. 10A and 10B, the temperature of the air that has traveled between the tube elements in the vicinity of the outlet side of the partitioning portion 19 (in particular, TUBE Nos. 7~13) becomes lower compared to that in heat exchangers in the prior art, achieving a temperature distribution with overall consistency.

Figure 11A:
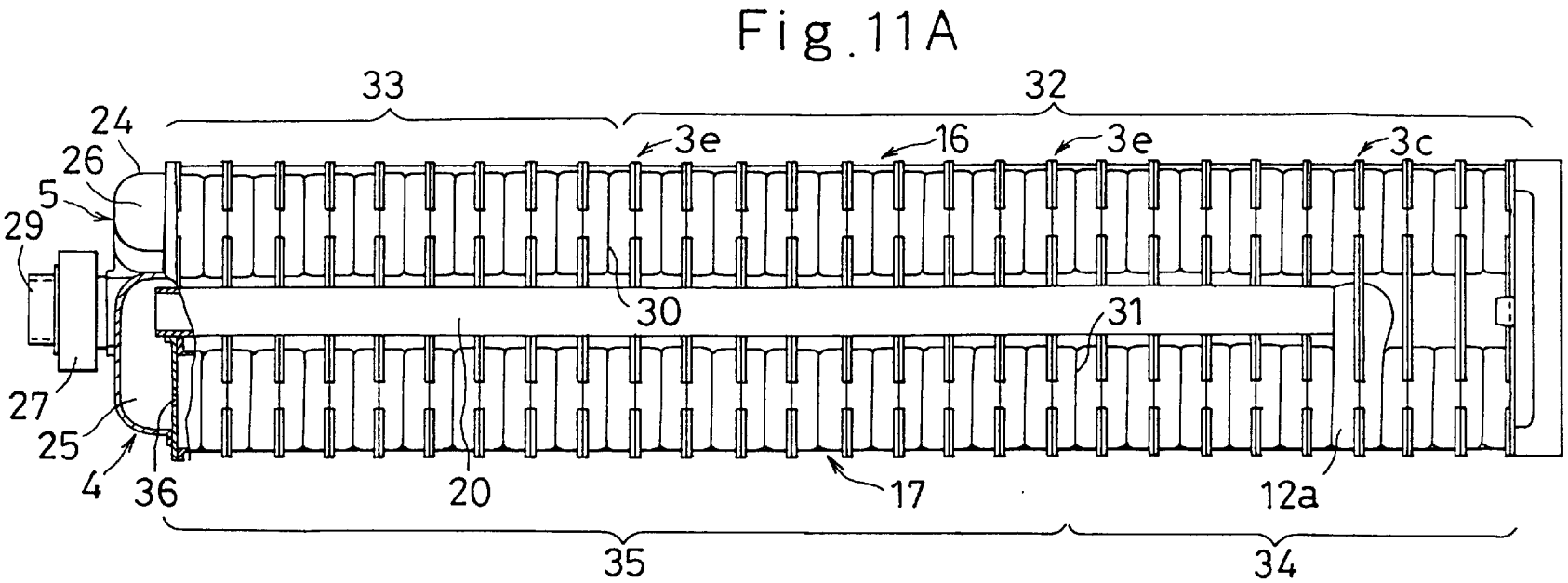
FIG. 11A is a bottom view of a 6-pass laminated heat exchanger in which heat exchanging medium is made to flow in through the intake portion to the first pass via a communicating pipe and heat exchanging medium is also made to flow directly into the fifth pass.
Figure 11B:
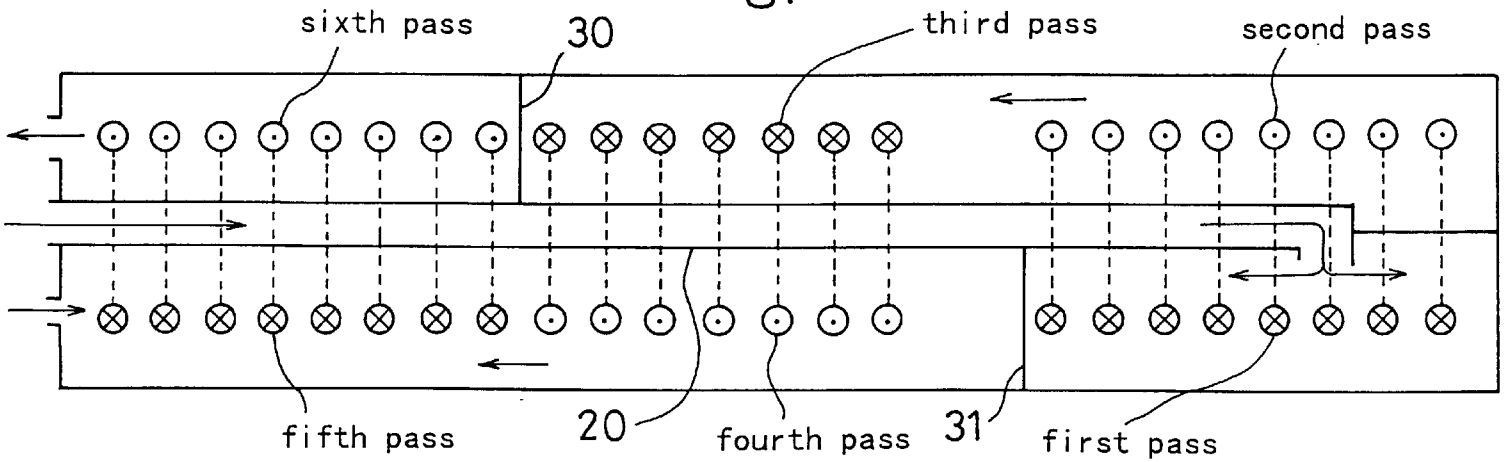
FIG. 11B is a conceptual diagram illustrating the flow of heat exchanging medium in this 6-pass laminated heat exchanger.
Figure 12A:
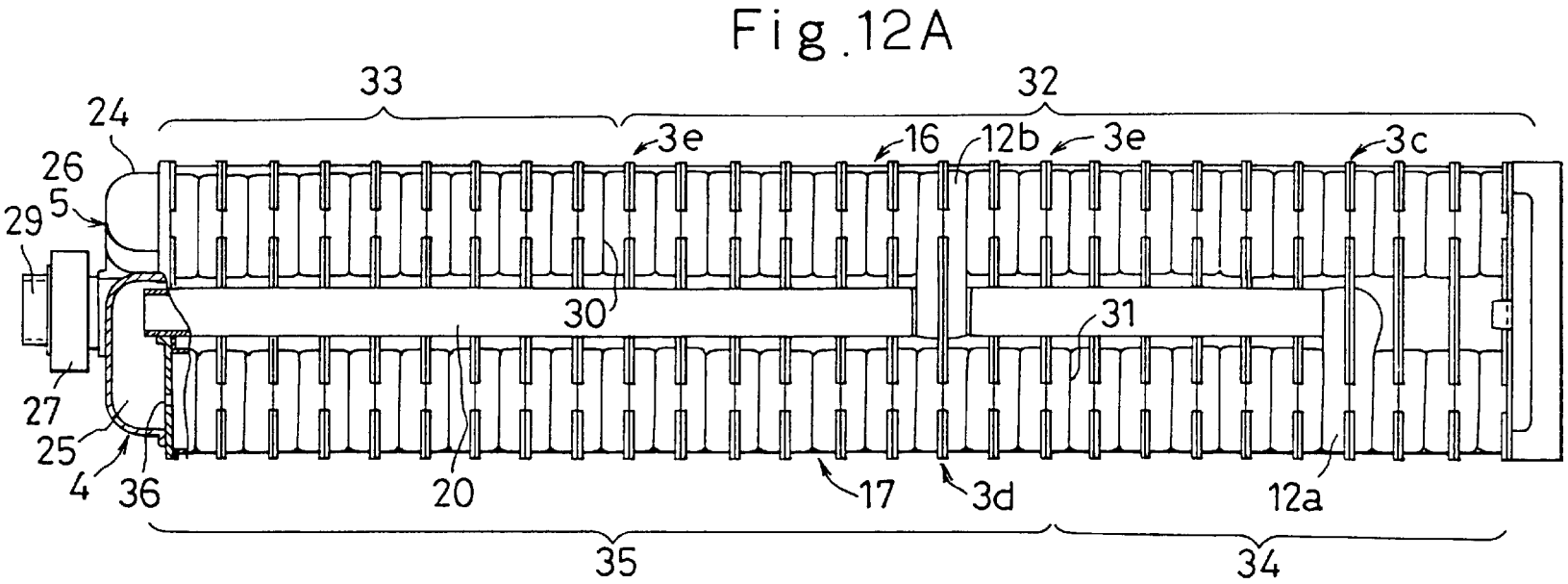
FIG. 12A is a bottom view of a 6-pass laminated heat exchanger in which heat exchanging medium is made to flow directly from the intake portion to the fifth pass, and heat exchanging medium is also made to flow into the first and third passes via a communicating pipe.
Figure 12B:
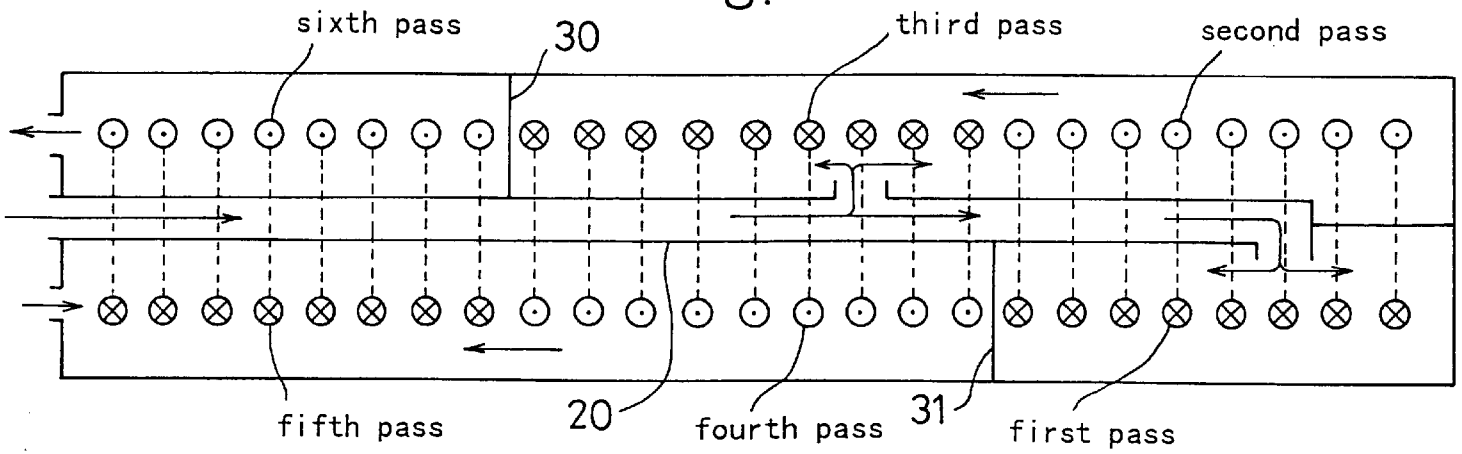
FIG. 12B is a conceptual diagram illustrating the flow of the heat exchanging medium in this 6-pass laminated heat exchanger.
Figure 13A:
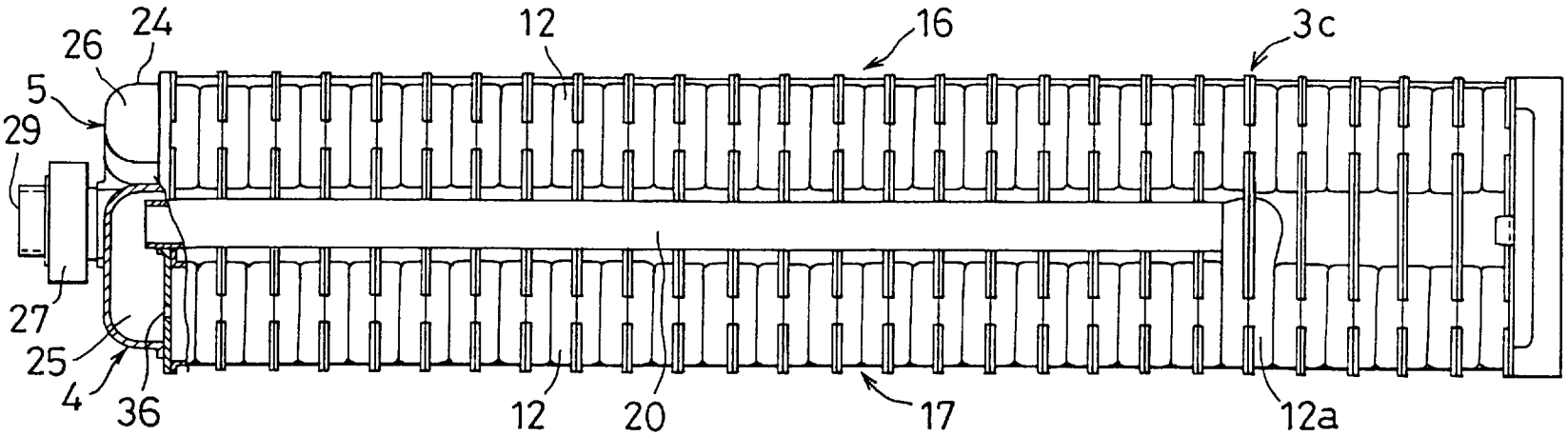
FIG. 13A is a bottom view of a 2-pass laminated heat exchanger in which heat exchanging medium is made to flow in through the intake portion to the first pass via a communicating pipe and heat exchanging medium is also made to flow directly through a small hole.
Figure 13B:
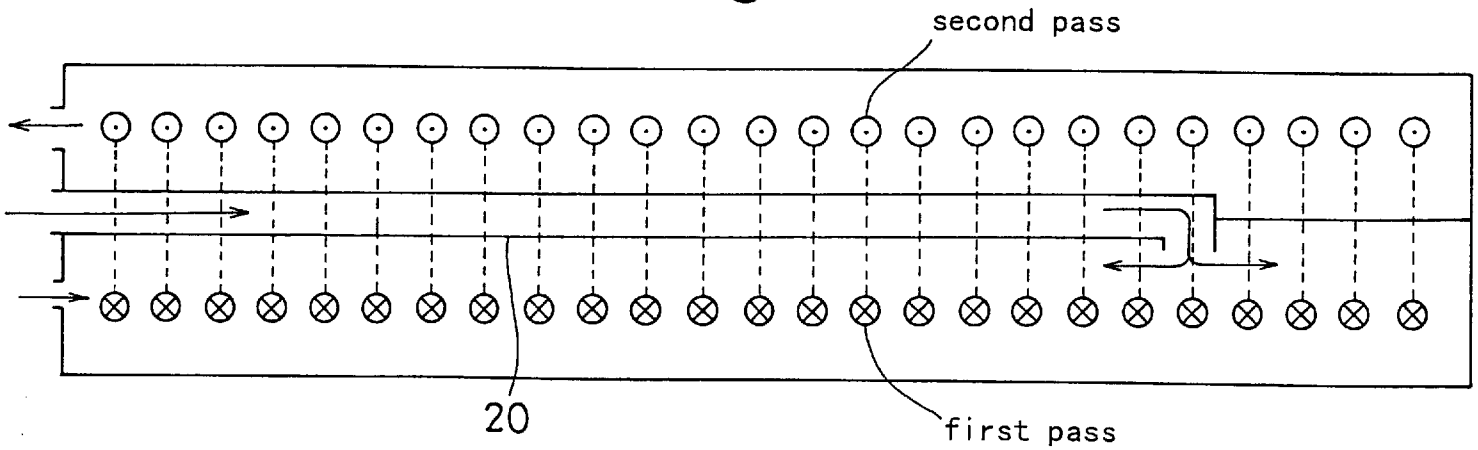
FIG. 13B is a conceptual diagram illustrating the flow of heat exchanging medium in this 2-pass laminated heat exchanger.
Figure 14A:
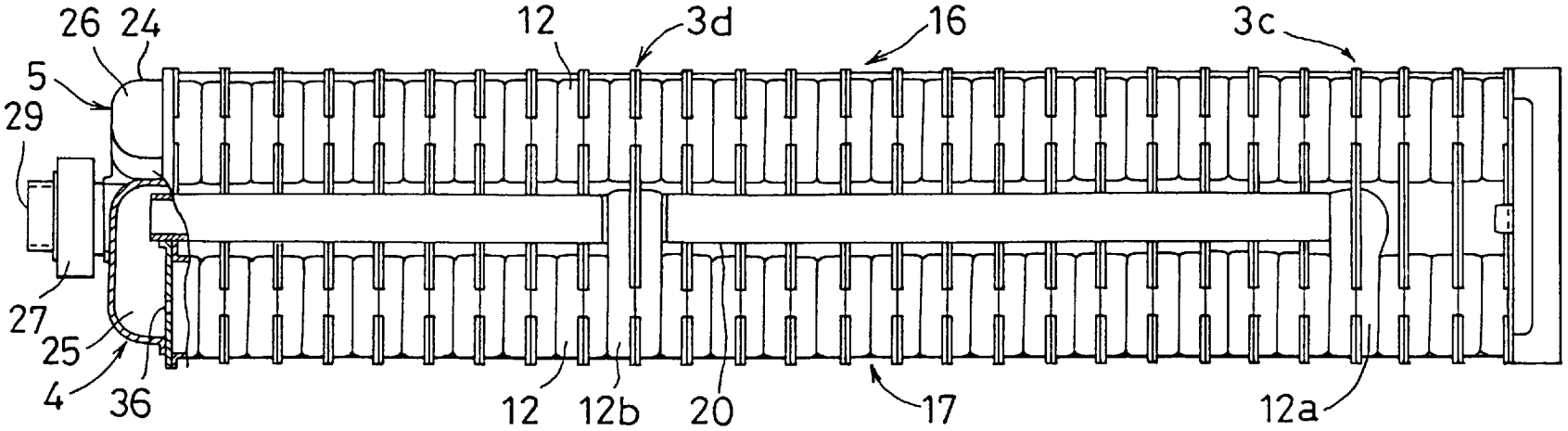
FIG. 14A is a bottom view of a 2-pass laminated heat exchanger in which heat exchanging medium is made to flow directly in through the intake portion to the first pass and heat exchanging medium is made to flow to the first pass from the end portion and the middle portion of the communicating pipe.
Figure 14B:
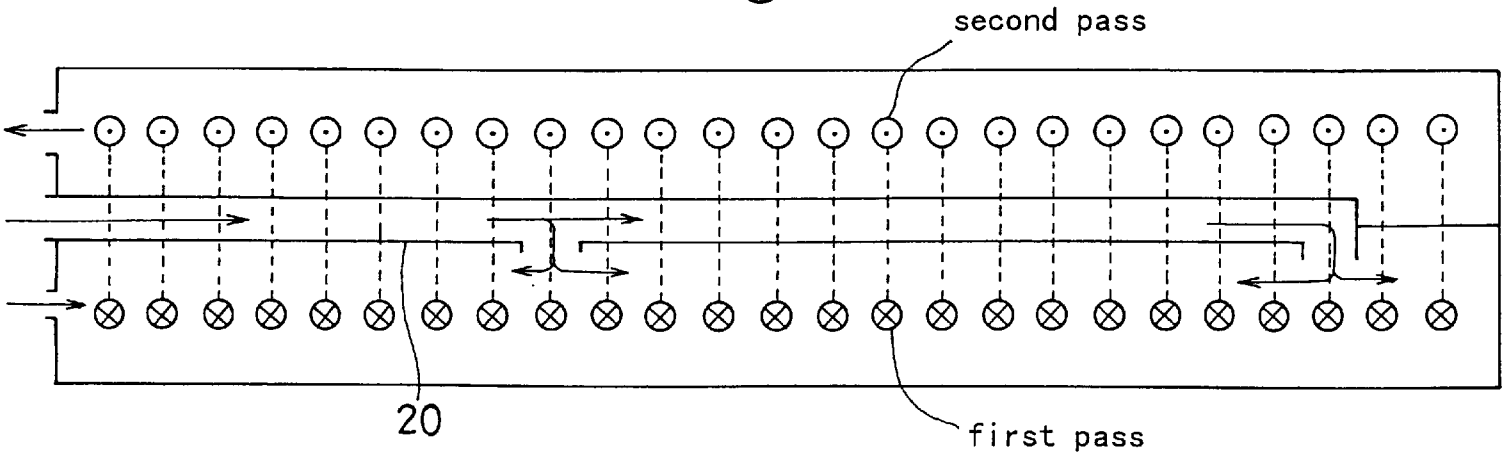
FIG. 14B is a conceptual diagram illustrating the flow of the heat exchanging medium in this 2-pass laminated heat exchanger.
Figure 15:
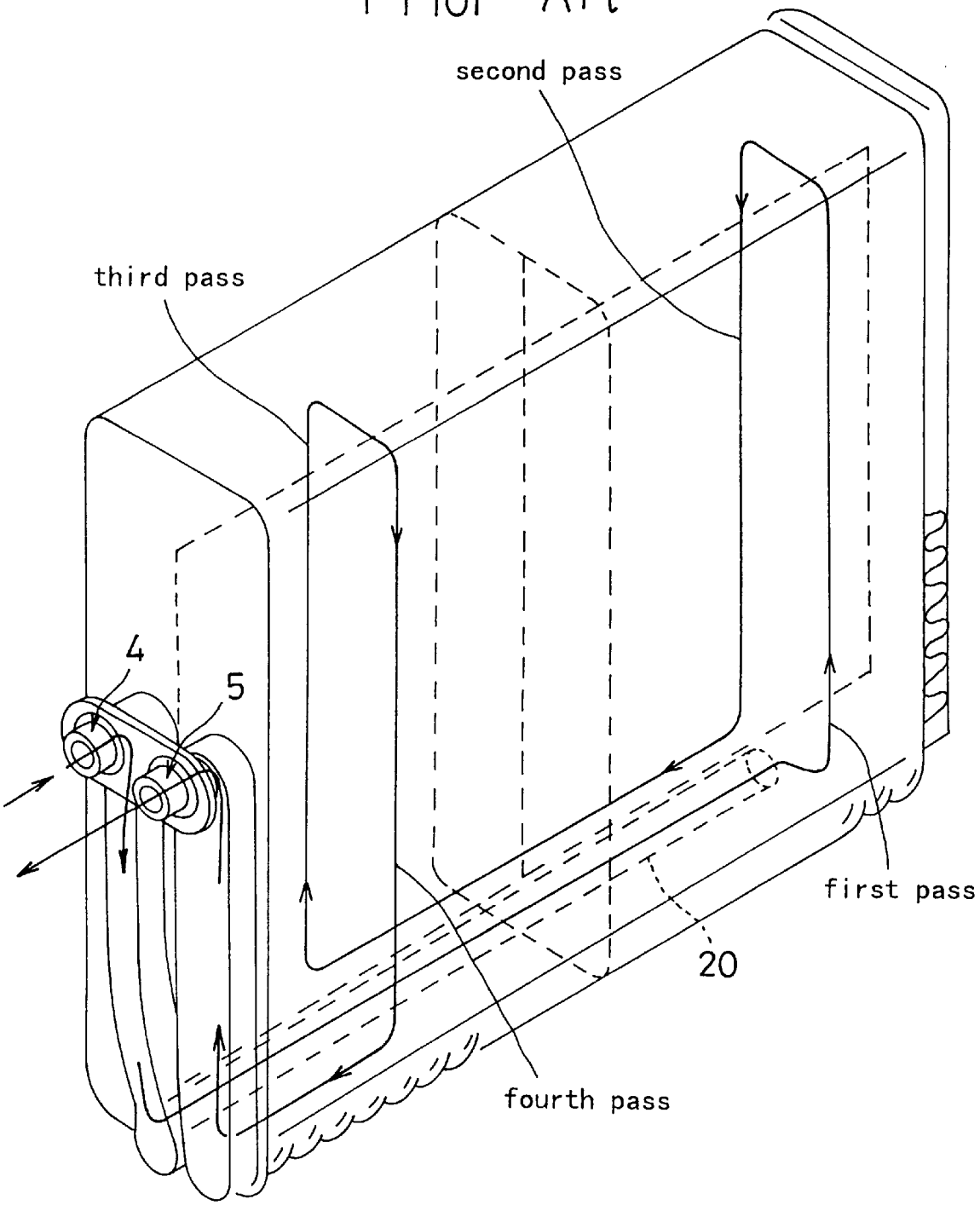
Fig. 15 Prior Art
FIG. 15 shows a schematic structure of a 4-pass laminated heat exchanger in the prior art in perspective.
Figure 16A:
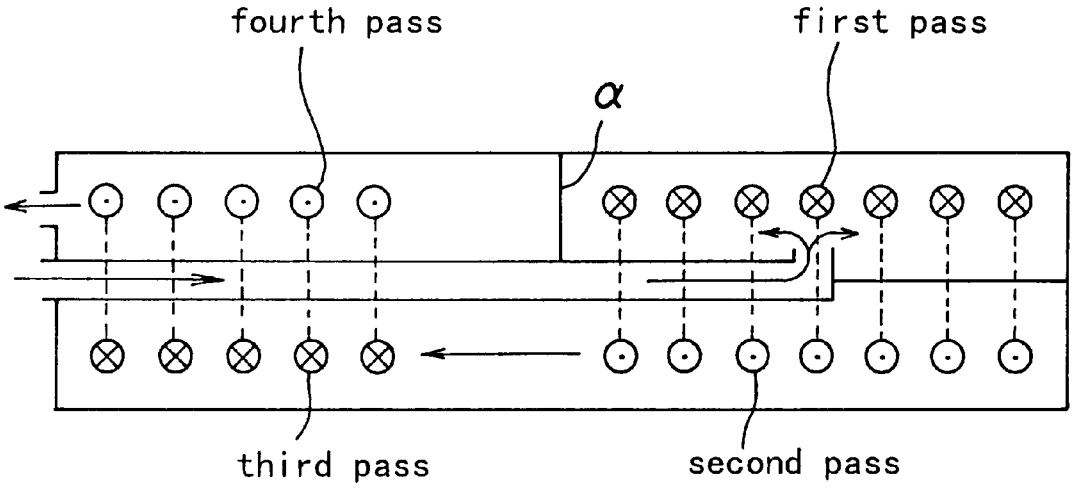
Fig. 16A Prior Art
FIG. 16A is a conceptual diagram illustrating the flow of heat exchanging medium in the laminated heat exchanger shown in FIG. 15.
Figure 16B:
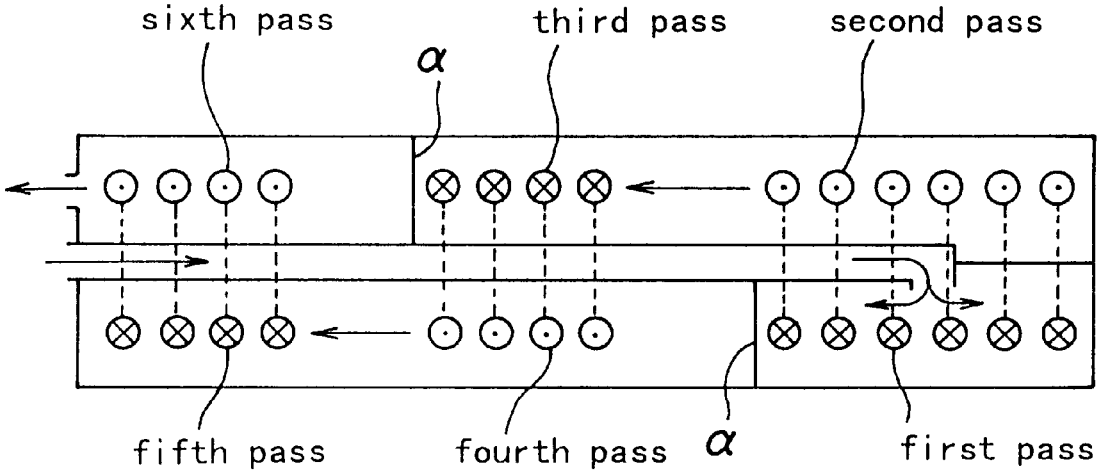
Fig. 16B Prior Art
FIG. 16B is a conceptual diagram illustrating the flow of heat exchanging medium in a 6-pass laminated heat exchanger.

FIGS. 11 through 14 show other embodiments of the heat exchanger in which a small hole 36 that is similar to the hole described earlier is formed at an end of the core main body, with FIGS. 11 and 12 showing 6-pass heat exchangers and FIGS. 13 and 14 showing 2-pass heat exchangers.

In the heat exchanger shown in FIG. 11, the pass that immediately precedes the most downstream pass, i.e., the fifth pass, communicates with the intake portion 4 and, as a result, the coolant that has flowed in through the intake portion 4 flows into the first tank block 32 via the communicating pipe 20, and flows out through the outlet portion 5 after traveling through a plurality of passes, and at the same time, coolant flows in directly to the fifth pass via the small hole 36, which then joins with the coolant flowing from the fourth pass so that the coolant becomes dispersed throughout all the tube elements constituting the fifth pass to pass through the U-turn passages. Because of this, of the tube elements constituting the fifth and sixth passes, the tube elements in the vicinity of the downstream side of the partitioning portion 30 will also have a flow of coolant in sufficient quantity, achieving an improvement in the temperature distribution.

While the structure described above at least improves the flow in the fifth and sixth passes and the improvement in temperature distribution is achieved within that limit, it is still a cause for concern that the coolant may concentrate toward the downstream side in the third and fourth passes. Thus, the heat exchanger shown in FIG. 6 is modified so that the intake portion 4 and the fifth pass communicate directly through the small hole 36, as shown in FIG. 12. By adopting this structure, the coolant is made to disperse almost consistently in the third and fourth passes as well as in the fifth and sixth passes, achieving an overall temperature distribution without any inconsistency.

In addition, in the 2-pass heat exchanger shown in FIG. 13, which is constituted by laminating over 27 levels, the intake portion 4 is connected to an enlarged tank portion of the tube element 3*c* at the twenty second level via the communicating pipe 20, and the intake portion 4 is made to communicate with the pass that immediately precedes the most downstream pass, i.e., first pass, via the small hole 36. Thus, coolant that has flowed in through the intake portion 4 enters the second tank group 17 after traveling through the communicating pipe 20 and also it flows directly into the second tank group via the small hole 36 so that the two flows will join and travel together through the U-turn passage of each tube element to flow out to the outlet portion 5 from the first tank group 16. In this structure, too, by adjusting the size of the small hole 36 as appropriate, it becomes possible to adjust the flow of the coolant that flows into the second tank group 17 from the communicating pipe 20 and the flow of coolant that flows into the second tank group from the small hole 36, thereby achieving an almost consistent temperature distribution by causing the coolant to become dispersed almost consistently throughout.

In particular, in the case of a 2-pass heat exchanger, although it is expected to be difficult to disperse the coolant consistently throughout all the elements, since the number of tube elements comprising each pass is great, this concern may be eliminated by adopting a structure in which, as shown in FIG. 14, the tube element 3*d* with the enlarged tank portion 12*b* is provided at the central portion of the core main body so that coolant can flow into the second tank group 17 from the middle of the communicating pipe 20 as well.

As has been explained, according to the present invention, in a heat exchanger provided with an intake portion and an outlet portion for heat exchanging medium at one end of the core main body in the direction of lamination, since the heat exchanging medium is made to flow readily into the vicinity where the odd-numbered pass changes from the even-numbered pass, it is possible to cause the heat exchanging medium to flow in sufficient quantity to the tube elements in the vicinity of the downstream side of the partitioning portion. Thus, an unbalanced flow of the heat exchanging medium is prevented, thereby improving the temperature distribution in the heat exchanger and achieving an improvement in heat exchanging efficiency.

Moreover, in a heat exchanger in the prior art, in which heat exchanging medium flows unevenly, the passage resistance is greater, since the heat exchanging medium flows in a concentrated manner into tube elements at specific locations. According to the present invention, however, heat exchanging medium flows almost equally to each tube element, achieving a reduction in passage resistance.

What is claimed is:

1. A laminated heat exchanger comprising:

a plurality of elongated tube elements respectively formed by two elongated formed plates bonded together, each of said tube elements having first and second longitudinal ends and comprising a pair of tank portions at said first longitudinal end and a U-turn passage, having first and second leg portions extending from said first longitudinal end toward said second longitudinal end, fluidically communicating between said pair of tank portions;

a plurality of fins alternately laminated between said elongated tube elements;

an intake passage and an outlet passage provided at one end of said heat exchanger in a direction of lamination of said tube elements and said fins, said intake passage communicating with a heat exchanging medium intake port, and said outlet passage communicating with a heat exchanging medium outlet port;

wherein said tank portions from which said first legs of said U-turn passages respectively extend constitute a first tank group, and said tank portions from which said second legs of said U-turn passages respectively extend constitute a second tank group;

wherein said tank portions of said first tank group are divided into first and second tank blocks by a partition portion, said tank portions of said first tank block communicate with one another, and said tank portions of said second tank block communicate with one another;

wherein said tank portions of second tank group are divided into third and fourth tank blocks by a partition portion, said tank portions of said third tank block communicate with one another, and said tank portions of said fourth tank block communicate with one another;

wherein said first tank block is spaced remotely from said one end of said heat exchanger in said direction of lamination;

wherein one of said tank portions of said first tank block constitutes an enlarged tank portion, a communicating pipe is provided and fluidically connects said intake passage with said enlarged tank portion, and said fourth tank block is fluidically connected with said outlet passage at one end of said heat exchanger in said direction of lamination;

wherein a first pass is constituted by the tank portions of said first tank block, and said first leg portions of said U-turn passages formed in said tube elements which contain the tank portions of said first tank block;

wherein a second pass is constituted by said tank portions of said third tank block which are formed in said tube elements which contain the tank portions of said first tank block, and said second leg portions of said U-turn passages formed in said tube elements which contain the tank portions of said first tank block;

wherein a third pass is constituted by said tank portions of said second tank group which are formed in said tube elements which contain both said tank portions of said second tank block and said tank portions of said third tank block, and said second leg portions of said U-turn passages formed in said tube elements which contain both the tank portions of said second tank block and the tank portions of said third tank block;

wherein a fourth pass is constituted by said tank portions of said first tank group which are formed in said tube elements which contain both said tank portions of said second tank block and said tank portions of said third tank block, and said first leg portions of said U-turn passages formed in said tube elements which contain both the tank portions of said second tank block and the tank portions of said third tank block;

wherein a fifth pass is constituted by said tank portions of said second tank block which are formed in said tube elements which contain the tank portions of said fourth tank block, and said first leg portions of said U-turn passages formed in said tube elements which contain the tank portions of said fourth tank block;

wherein a sixth pass is constituted by said tank portions of said fourth tank block, and said second leg portions of said U-turn passages formed in said tube elements which contain the tank portions of said fourth tank block;

whereby heat exchanging medium which flows in from said intake port flows via said intake passage and said communicating pipe along said first pass, said second pass, said third pass, said fourth pass, said fifth pass and said sixth pass, and flows out from said outlet port via said outlet passage; and wherein a short circuit passage is provided and fluidically connects said intake passage with one of said passes disposed downstream of said second pass such that heat exchanging medium can flow from said intake passage to said one of said passes disposed downstream of said second pass without first having to flow through said first and second passes.

2. A laminated heat exchanger according to claim 1, wherein an endmost one of said tube elements, at said one end of said heat exchanger in said direction of lamination, is formed of an elongated flat plate, and an elongated formed plate having a distended tank portion at said first longitudinal end; and said short circuit passage comprises a small hole formed in said flat plate and communicating between said intake passage and said fifth pass.

3. A laminated heat exchanger according to claim 1, wherein said short circuit passage comprises a hole formed in an endmost plate at said one end of said heat exchanger in said direction of lamination, said hole communicating between said intake passage and said fifth pass.

4. A laminated heat exchanger according to claim 1, wherein one of said tank portions of said third pass constitutes an enlarged tank portion; and said short circuit passage comprises an opening from said communicating pipe into said enlarged tank portion of said third pass.

5. A laminated heat exchanger according to claim 1, wherein an endmost one of said tube elements, at said one end of said heat exchanger in said direction of lamination, is formed of an elongated flat plate, and an elongated formed plate having a distended tank portion at said first longitudinal end;

one of said tank portions of said third pass constitutes an enlarged tank portion; and said short circuit passage comprises a small hole formed in said flat plate and communicating between said intake passage and said fifth pass, and an opening from said communicating pipe into said enlarged tank portion of said third pass.

6. A laminated heat exchanger according to claim 1, wherein one of said tank portions of said third pass constitutes an enlarged tank portion; and said short circuit passage comprises an opening from said communicating pipe into said enlarged tank portion of said third pass, and a hole formed in an endmost plate at said one end of said heat exchanger in said direction of lamination, said hole communicating between said intake passage and said fifth pass.

* * * * *